US008070023B2

(12) United States Patent
Vitantonio et al.

(10) Patent No.: US 8,070,023 B2
(45) Date of Patent: Dec. 6, 2011

(54) BEVERAGE DISPENSING ASSEMBLY

(75) Inventors: Marc L. Vitantonio, South Russell, OH (US); William E. Rabbitt, Solon, OH (US); John W. Nottingham, Bratenahl, OH (US); John R. Nottingham, Bratenahl, OH (US); John W. Spirk, Jr., Gates Mills, OH (US); Jay Tapper, Shaker Heights, OH (US); John Replogle, Raleigh, NC (US); Jeffrey M. Kalman, Cleveland Heights, OH (US)

(73) Assignee: On Tap LLC, Cleveland Heights, OH (US)

( * ) Notice: Subject to any disclaimer, the term of this patent is extended or adjusted under 35 U.S.C. 154(b) by 825 days.

(21) Appl. No.: 11/684,326

(22) Filed: Mar. 9, 2007

(65) Prior Publication Data

US 2008/0217361 A1 Sep. 11, 2008

(51) Int. Cl.
*B65D 83/00* (2006.01)

(52) U.S. Cl. ..... 222/399; 222/5; 222/396; 222/400.7

(58) Field of Classification Search ..... 222/5, 80, 222/396, 399, 400.7, 464.4, 505, 394; 137/212
See application file for complete search history.

(56) References Cited

U.S. PATENT DOCUMENTS

| | | | | |
|---|---|---|---|---|
| 653,516 | A | 7/1900 | Kleinfeldt | |
| 2,051,981 | A * | 8/1936 | Bowman | 141/19 |
| 2,115,052 | A | 4/1938 | Ward | |
| 2,125,248 | A | 7/1938 | Taylor | |
| 2,159,729 | A | 5/1939 | Ribble | |
| 2,319,517 | A | 5/1943 | Rand | |
| 2,547,052 | A | 4/1951 | Sollmann | |
| 2,774,521 | A | 12/1956 | Creighton | |
| 2,842,293 | A * | 7/1958 | Knapp et al. | 222/399 |
| 2,917,906 | A | 12/1959 | Woolley | |
| 3,006,515 | A | 10/1961 | Midnight | |
| 3,150,799 | A | 9/1964 | Flynn | |
| 3,161,327 | A | 12/1964 | Kraus | |
| 3,195,779 | A | 7/1965 | Nicko | |
| 3,200,991 | A | 8/1965 | Mills | |
| 3,211,350 | A * | 10/1965 | Brown | 222/399 |
| 3,233,779 | A | 2/1966 | Cornelius | |
| 3,239,102 | A | 3/1966 | Heydon et al. | |
| 3,244,326 | A | 4/1966 | Bull, Jr. | |
| 3,294,289 | A | 12/1966 | Bayne et al. | |

(Continued)

FOREIGN PATENT DOCUMENTS

WO WO 2008/044923 A1 4/2008

(Continued)

OTHER PUBLICATIONS

Tap-A-Draft Instruction Sheet; Sturman BG, LLC.

(Continued)

*Primary Examiner* — Kevin P Shaver
*Assistant Examiner* — Daniel R Shearer
(74) *Attorney, Agent, or Firm* — Fay Sharpe LLP

(57) ABSTRACT

A beverage dispensing assembly that is capable of dispensing controlled or metered portions of a beverage charged with a gas fits onto a shelf in a conventional household refrigerator. The beverage dispensing assembly includes a sealed disposable container assembly that contains the beverage and a dispensing assembly that cooperates with the container assembly to selectively unseal the container assembly and dispense controlled portions of the beverage from the container assembly.

25 Claims, 17 Drawing Sheets

U.S. PATENT DOCUMENTS

| | | | | |
|---|---|---|---|---|
| 3,317,089 | A | | 5/1967 | Kopczynski |
| 3,325,053 | A | * | 6/1967 | De Boer et al. ..... 222/5 |
| 3,327,899 | A | | 6/1967 | Reynolds et al. |
| 3,343,726 | A | | 9/1967 | Johanningmeier |
| 3,373,907 | A | * | 3/1968 | Batrow . ..... 222/399 |
| 3,403,820 | A | | 10/1968 | Landis et al. |
| 3,561,649 | A | | 2/1971 | Wilson |
| 3,583,289 | A | | 6/1971 | Wilson et al. |
| 3,613,954 | A | | 10/1971 | Bayne |
| 3,843,172 | A | | 10/1974 | Stevens, Jr. |
| 4,032,047 | A | | 6/1977 | Wilson |
| 4,120,425 | A | | 10/1978 | Bethurum |
| 4,222,972 | A | | 9/1980 | Caldwell |
| 4,264,019 | A | | 4/1981 | Roberts et al. |
| 4,402,429 | A | * | 9/1983 | Vanden Driessche ... 222/153.01 |
| 4,520,950 | A | | 6/1985 | Jeans |
| 4,632,276 | A | * | 12/1986 | Makino ..... 222/80 |
| 4,735,348 | A | * | 4/1988 | Santoiemmo et al. ..... 222/399 |
| 4,765,512 | A | | 8/1988 | Bull, Jr. |
| 4,785,972 | A | | 11/1988 | LeFevre |
| 4,919,310 | A | | 4/1990 | Young et al. |
| 4,923,095 | A | | 5/1990 | Dorfman et al. |
| 4,940,169 | A | | 7/1990 | Ball |
| 4,982,876 | A | | 1/1991 | Scott |
| 4,984,717 | A | | 1/1991 | Burton |
| 5,022,565 | A | | 6/1991 | Sturman et al. |
| 5,096,095 | A | | 3/1992 | Burton |
| 5,110,012 | A | | 5/1992 | Scholle et al. |
| 5,129,552 | A | | 7/1992 | Painchaud et al. |
| 5,260,081 | A | | 11/1993 | Stumphauzer et al. |
| 5,329,975 | A | * | 7/1994 | Heitel ..... 141/19 |
| 5,979,713 | A | | 11/1999 | Grill |
| 5,979,715 | A | * | 11/1999 | Emrick ..... 222/464.4 |
| 6,360,923 | B1 | | 3/2002 | Vlooswijk |
| 6,386,403 | B2 | * | 5/2002 | Parsons et al. ..... 222/399 |
| 6,502,406 | B2 | | 1/2003 | Niehaus |
| 6,502,725 | B1 | | 1/2003 | Alexander |
| 6,516,839 | B1 | | 2/2003 | Timp et al. |
| 6,530,235 | B2 | | 3/2003 | Halimi et al. |
| 6,546,737 | B1 | | 4/2003 | Heyes et al. |
| 6,553,779 | B1 | | 4/2003 | Boyer et al. |
| 6,616,011 | B2 | | 9/2003 | Derry et al. |
| 6,651,852 | B2 | | 11/2003 | Arellano |
| 6,814,383 | B2 | | 11/2004 | Reed, III et al. |
| 6,824,017 | B2 | | 11/2004 | Sluijter |
| 2003/0038145 | A1 | | 2/2003 | Arellano |
| 2005/0263578 | A1 | | 12/2005 | Wang |
| 2005/0268985 | A1 | | 12/2005 | Litto |
| 2005/0269361 | A1 | | 12/2005 | Prabucki |

FOREIGN PATENT DOCUMENTS

| | | | |
|---|---|---|---|
| WO | WO 2008/048098 | A1 | 4/2008 |
| WO | WO 2008/066376 | A1 | 6/2008 |

OTHER PUBLICATIONS

International Search Report PCT/US2008/056187 dated Mar. 7, 2008.

Written Opinion of the International Searching Authority (Form PCT/ISA/237) PCT/US2008/056187 dated Mar. 7, 2008.

International Search Report PCT/US2008/056187 dated Jul. 16, 2008.

Written Opinion of the International Searching Authority (Form PCT/ISA/237) PCT/US2008/056187 dated Jul. 16, 2008.

* cited by examiner

BEVERAGE DISPENSING ASSEMBLY

BACKGROUND

Draft, or draught, beer and carbonated fountain drinks are typically delivered under pressure and include gas, typically nitrogen or carbon dioxide depending on the type of beverage, dissolved in the beverage. These beverages are typically enjoyed at restaurants, bars and other establishments where it makes sense to invest in the devices, e.g. taps, refrigerators, lines, pressure sources and fountain dispensers, that are required to dispense the beverage. To enjoy these beverages at home, typically a consumer must purchase a small portion of the beverage packaged in a can or a bottle. Often times this smaller portion found in a can or bottle is not as enjoyable as its draft or fountain counterpart.

Attempts have been made to provide a beverage dispenser capable of delivering portions of draft beer or a carbonated fountain drink, e.g., soda, where the dispenser is suitable for home usage. Previous approaches include a pressurized gas source, e.g., cartridge, within the liquid containing vessel, typically a bottle or can. In these known devices the gas pressure regulator, which regulates the pressure of the gas that is delivered to the beverage, is found within the liquid containing vessel. This arrangement of components results in the disposal of the costly gas pressure regulator after the beverage in the vessel has been consumed.

Other previous approaches have required the consumer to purchase or incorporate a separate tap and pressurizing system for delivering the beverage. Other approaches, for delivering beer particularly, also include providing a relatively large can, in relation to a typical 12 ounce can which is found in the United States, but these large cans of beer must be consumed relatively quickly, i.e. in at least two days, or the beer would become flat and no longer fresh.

SUMMARY

In view of the above, disclosed is a beverage dispenser that can deliver desired portions of a pressurized beverage from a vessel containing multiple portions and allow the beverage to stay fresh for a longer period of time as compared to many known beverage containers and dispensers. In one embodiment, a beverage dispensing assembly that is capable of dispensing a beverage charged with a gas fits onto a shelf in a conventional household refrigerator. The beverage dispensing assembly comprises a sealed disposable container assembly that contains the beverage and a dispensing assembly that cooperates with the container assembly to unseal the container assembly and dispense portions of the beverage from the container assembly. The container assembly connects to the dispensing assembly in a manner to allow for disconnection of the container assembly from the dispensing assembly when the beverage has been dispensed from the container assembly and replacement of an empty or nearly empty container assembly with a new sealed container assembly.

A system for dispensing metered portions of a beverage charged with a gas includes a bottle assembly and a dispensing assembly. The bottle assembly includes a bottle and a cap assembly. The bottle includes a neck defining an outlet. The cap assembly includes a pressurized gas cartridge, a beverage valve and a gas valve. The cap is configured to attach onto the neck of the bottle to close the bottle. The pressurized gas cartridge is received in the cap. The beverage valve in the cap allows a desired portion of beverage to leave the bottle and the gas valve allows pressurized gas to enter the bottle. The dispensing assembly is configured to cooperate with the bottle assembly to dispense the beverage from the bottle. The dispensing assembly includes a housing, a spout, and a pressure regulator. The housing supports the bottle, the spout and the pressure regulator. The spout is in fluid communication with the beverage valve for dispensing fluid from the bottle. The pressure regulator is in fluid communication with the pressurized gas cartridge and the gas valve. The pressure regulator receives pressurized gas from the pressurized gas cartridge at a first pressure and delivers pressurized gas to the bottle through the gas valve at a second pressure.

A dispensing assembly for delivering a metered amount of beverage from an associated container that holds the beverage includes a housing, a spout, and a pressure regulator. The housing is configured to receive an associated sealed container storing a beverage. The housing is dimensioned so that the housing and the associated container that the housing is configured to receive fit into an associated conventional household refrigerator and onto a conventional refrigerator shelf. The spout connects to the housing. The spout includes an inlet for receiving beverage from the associated container and an outlet for dispensing beverage. The pressure regulator connects to the housing. The pressure regulator is configured to communicate with an associated pressurized gas cartridge and the associated container to receive pressurized gas from the associated gas cartridge at a first pressure and to deliver pressurized gas to the associated container at a second pressure that is lower than the first pressure.

A disposable container assembly for dispensing a portioned amount of fluid beverage includes a container and a cap. The container stores a beverage. The cap connects to the container for sealing the beverage in the container. The cap includes a cartridge receptacle disposed in the container when the cap is connected to the container.

A disposable container assembly for use with a dispensing assembly that dispenses beverage under pressure includes a sealed disposable bottle, a sealed pressurized gas cartridge, a first plug and a second plug. The sealed disposable bottle includes a gas inlet and a beverage outlet. The sealed pressurized gas cartridge is received in the bottle and arranged to be pierced by an associated dispensing assembly when the bottle is loaded into the associated dispensing assembly. The first plug blocks a passage in communication with the beverage outlet. The first plug precludes the egress of beverage from the bottle when in a closed position and allows the egress of beverage from the bottle when in an open position. The second plug blocks a passage in communication with the beverage outlet. The second plug precludes the egress of beverage from the bottle when in a closed position and allows the ingress of gas into the bottle when in the open position.

A disposable draft beverage refill bottle assembly for use with a dispenser includes a bottle, a cap, a first member, and a second member. The bottle contains a draft beverage. The cap connects to the bottle and contains the beverage in the bottle. The cap includes first and second passages for providing selective communication between inside the bottle and ambient. The first member is disposed in the first passage and has a first operating position that precludes the draft beverage from leaving the bottle and a second operating position that allows the draft beverage to leave the bottle. The second member is disposed in the second passage and has a first operating position that precludes the draft beverage from leaving the bottle and a second operating position that allows pressurized gas to enter the bottle.

A cap for a bottle containing a draft beverage includes a side wall, an end wall, a passage and a cartridge receptacle. The side wall has an inner surface that is generally axially symmetric with respect to a symmetrical axis. The end wall is disposed at or adjacent an end of the side wall. The passage is formed through the end wall generally aligned with the symmetrical axis. The cartridge receptacle is at least partially surrounded by the side wall.

A container assembly for holding a pressurized beverage to be dispensed using an associated dispenser includes a sealed container, a sealed gas cartridge, and a sealed passage. The sealed container stores the beverage under pressure. The sealed gas cartridge is disposed in the container. The sealed passage is arranged to be unsealed when the container is loaded into the associated dispenser and to be unsealed when the associated dispenser is in a dispense operating position.

A cap assembly for a bottle containing a beverage under pressure includes a cap, a gas cartridge, a first normally closed valve and a second normally closed valve. The cap includes a first passage and a second passage. The gas cartridge is received in the cap. The first normally closed valve is disposed in the first passage. The second normally closed valve is disposed in the second passage.

A system for dispensing servings of a beverage charged with a gas includes a sealed bottle and a dispenser. The sealed bottle contains a beverage charged with gas and includes a first sealed passage and a second sealed passage each in communication with inside of the bottle. The dispenser cooperates with the bottle to dispense the beverage from the bottle. The dispenser includes a housing, a spout, a pressure regulator, a first spike and a second spike. The housing receives the bottle. The spout is in fluid communication with the first passage for dispensing the beverage from the bottle. The pressure regulator is in fluid communication with the second passage for delivering pressurized gas to inside the bottle. The first spike unseals the first passage and the second spike unseals the second passage.

BRIEF DESCRIPTION OF THE DRAWINGS

FIG. 7 is a cross-sectional view of the bottle assembly prior to insertion into the dispensing assembly.

FIG. 8 is a cross-sectional view of the bottle assembly connected to the dispensing assembly with a locking lever in an unlocked position.

FIG. 9 is a cross-sectional view of the beverage dispensing assembly with the handle in a locked position.

FIG. 10 is a cross-sectional view similar to FIG. 9, but showing different components of the beverage dispensing assembly in cross section.

FIG. 11 is a cross-sectional view similar to that shown in FIGS. 9 and 10 showing a spout of the beverage dispensing assembly in a locked position.

FIG. 12 is a view similar to FIG. 11, however, the spout is rotated into an open position.

FIG. 13 is a cross-sectional view similar to FIGS. 11 and 12, but a tap handle is rotated to a dispense position.

FIG. 14 is a cross-sectional view similar to FIG. 13, but taken to show different components of the beverage dispensing assembly in cross-section.

FIG. 15 is a cross-sectional view depicting the bottle assembly being removed from the dispensing assembly.

DETAILED DESCRIPTION

Figure 1:
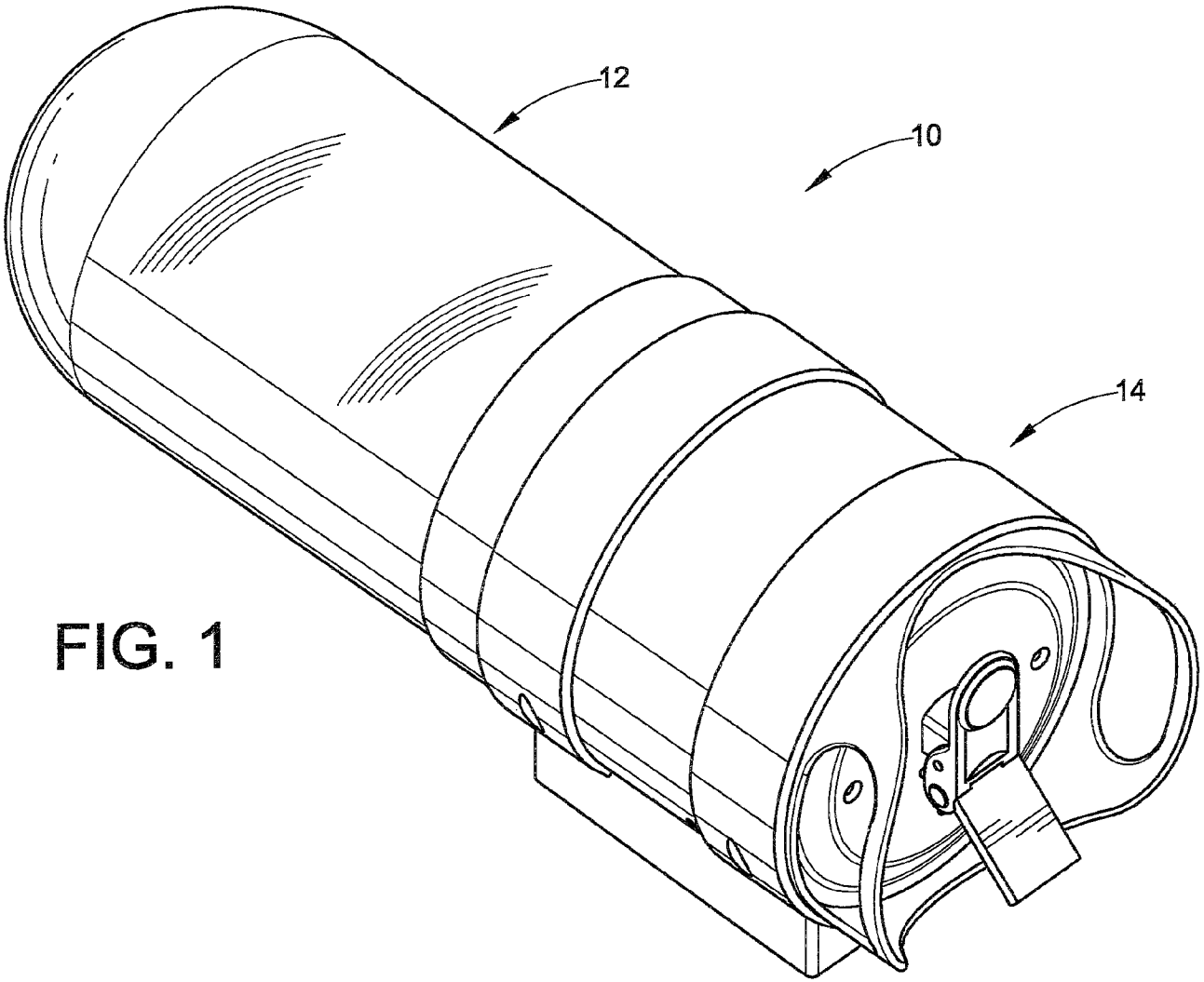
FIG. 1 is a perspective view of a beverage dispensing assembly.

A beverage dispensing assembly 10, per the embodiment depicted in FIG. 1, includes a bottle assembly 12 and a dispensing assembly 14. The dispensing assembly 10 as shown in FIG. 1 is dimensioned and configured so that it fits into a conventional household refrigerator. More particular to the embodiment depicted in FIG. 1, the beverage dispensing assembly 10 is configured to rest in a generally horizontal configuration, e.g., the axis of symmetry for the bottle of the assembly resides generally parallel to a plane of the refrigerator shelf upon which the beverage dispensing assembly 10 will rest. Moreover, the beverage dispensing assembly 10 that is depicted in FIG. 1 has a height that is limited in its greatest dimension so that the beverage dispensing assembly can fit onto a conventional household refrigerator shelf, typically, a middle shelf where an upper shelf resides above the shelf upon which the beverage dispensing assembly 10 resides. The length, or depth, of the assembly is also limited to less than about 40 cm so that the refrigerator door can close and seal. The beverage dispensing assembly 10 can have dimensions that are roughly equal to the dimensions of a 12 pack of beverage cans sold in a cardboard or paperboard box where the cans are stacked 6 by 2, which is more particularly described, for example, in U.S. Pat. No. 6,484,903.

Alternatively, the bottle assembly 12 and the dispensing assembly 14 can be configured in a manner to allow the beverage dispensing assembly 10 to reside in a generally vertical configuration, for example, where the beverage dispensing assembly may be received in a shelf found in a refrigerator door of a conventional household refrigerator Other possible configurations also exist that are within the scope of the invention.

The beverage dispensing assembly 10 is useful in delivering metered portions of draft beer or fountain soda, both of which will be referred to as a draft beverage, without requiring the consumer to purchase a keg and tap assembly in the case of draft beer or a fountain dispenser and other equipment required to dispense fountain soda. The beverage dispensing assembly 10 provides a disposable, which is meant to include recyclable, bottle assembly where inexpensive components are disposed or recycled and the costlier components, e.g. a pressure regulator, is not thrown away. The assembly delivers a fresh tasting beverage each time over an extended period of time, e.g. at least about 21 days.

Figure 2:
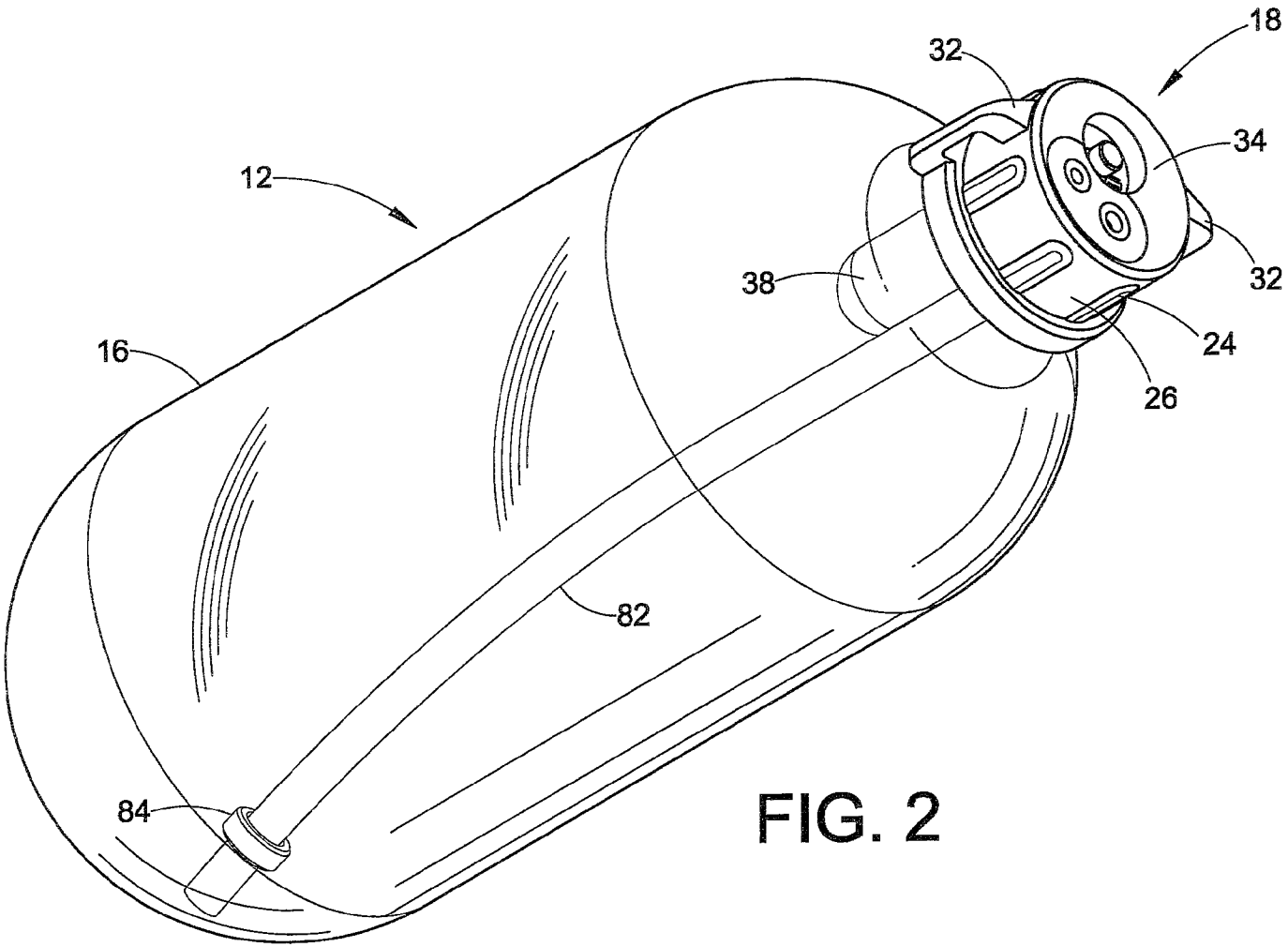
FIG. 2 is a perspective view of a bottle assembly of the beverage dispensing assembly shown in FIG. 1.

With reference to FIG. 2, the bottle assembly 12 includes a bottle 16 and a cap assembly 18. The bottle assembly 12 fits into the dispensing assembly 14 (FIG. 1) and is manufactured to be disposable or recyclable. A consumer purchases the beverage dispensing assembly 10 and dispenses the beverage. After the beverage is dispensed and consumed, the consumer removes the empty bottle assembly 12 from the dispensing assembly 14 and buys a replacement bottle assembly to fit into the dispensing assembly.

Figure 3:
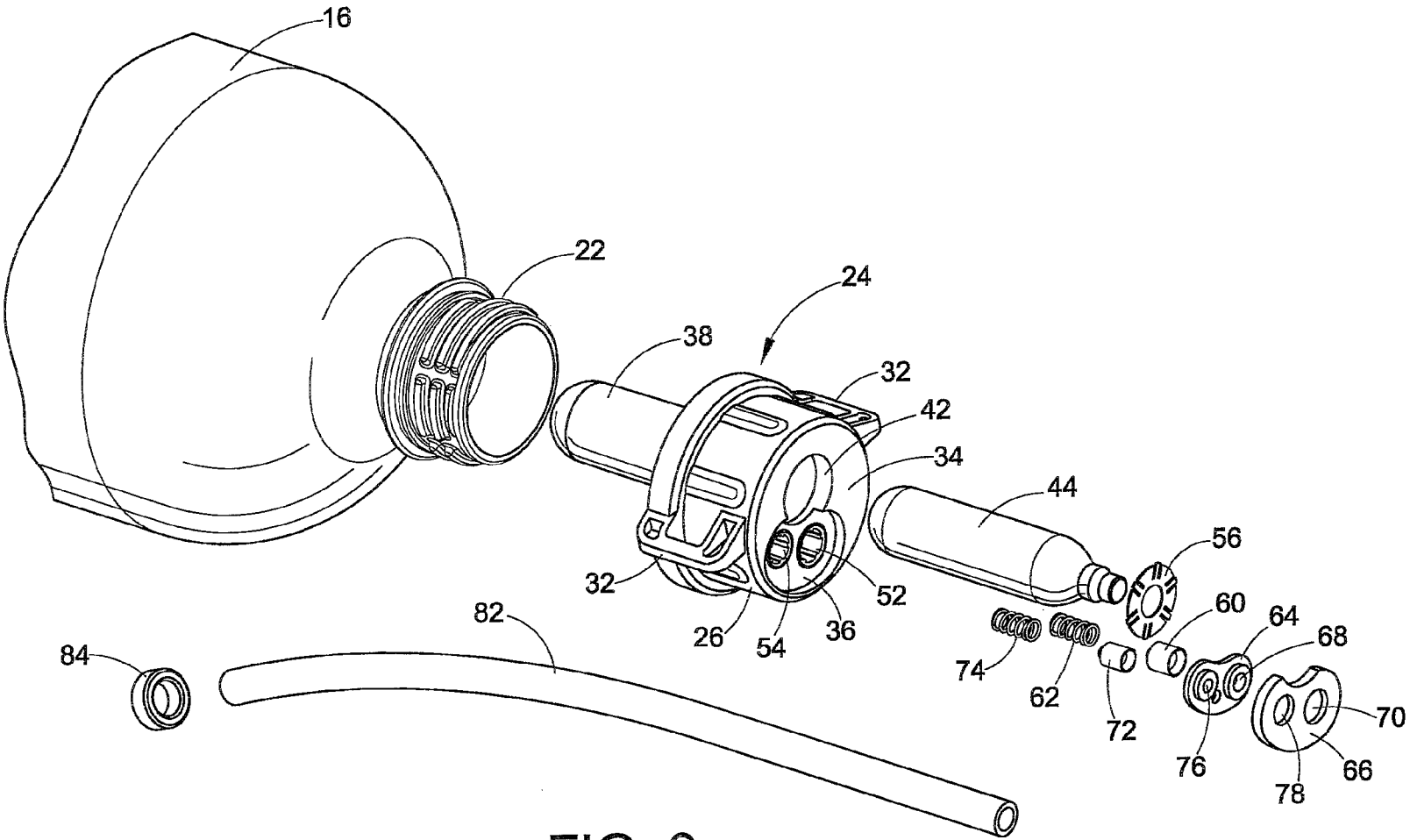
FIG. 3 is an exploded view of the bottle assembly shown in FIG. 2.

The bottle 16 as shown in the depicted embodiment is a blow molded axially symmetric bottle having an externally threaded neck 22 (FIG. 3). In the depicted embodiment, the bottle can be manufactured to have an internal volume of between about 1 liter and about 5 liters, and even larger if desired. The larger the internal volume allows a manufacturer to spread the cost associated with the cap assembly 18 over a larger amount of beverage, which drives down the unit cost of the beverage. Other materials for the bottle 16 can be used, but plastic is easily recyclable and the threaded neck 22, which could be modified so that it does not include threads, allows for easy removal of the cap assembly 18 when all the beverage has been dispensed. This allows for separation of the cap assembly 18 from the bottle 16 so that the dissimilar materials used in the cap assembly can be separated from the bottle. The diameter of the bottle 16 in the depicted embodiment is between about 7 cm and about 16 cm, which is typically less than the height of a shelf in a conventional household refrigerator. Where the beverage dispensing assembly 10 is configured to be placed into a door of a conventional household refrigerator, the diameter of the bottle 16 can be between about 13 cm and about 18 cm. The assembly 10 has a length measured along a central axis of about 33 cm to about 40 cm, which is less than the depth of the refrigerator compartment of a conventional household refrigerator so that the beverage dispensing assembly can sit on the shelf horizontally. In the depicted embodiment, the bottle 16 is clear and/or translucent to allow the consumer to see the beverage inside the bottle. If desired, the bottle can be opaque, especially where the bottle is made from a material other than plastic.

The cap assembly 18 covers the opening through which the bottle 16 is filled with beverage and retains the beverage in bottle 16 during shipment. In the depicted embodiment, the cap assembly includes openings for dispensing the beverage and providing pressurized gas to the beverage, which will be explained in more detail below. In alternative embodiments, the passages for dispensing the beverage and for providing pressurized gas to the bottle can be formed in the bottle—one non-limiting example being passages formed near and radially offset from the neck 22. With reference back to the embodiment depicted in FIG. 3, the cap assembly 18 generally includes a cap 24, a pressure source, and valve assemblies. These can also be located in the bottle, if desired.

The cap 24 threads on to the threaded neck 22 of the bottle 16. The cap 24 could connect to the bottle in other manners, e.g. a bayonet connection, a snap fit, or welding. With reference back to the embodiment of FIG. 3, the cap 24 includes a generally cylindrical side wall 26 having internal threads 28 (FIG. 8) formed on an inner surface for threadingly engaging the threaded neck 22. The cap 24 also includes two catches 32 that extend outwardly from the cylindrical side wall 26 of the cap 24. The catches 32 are generally U-shaped bars and the terminal portions attach to the cylindrical side wall 26 to define an opening to facilitate attaching the bottle assembly 12 to the dispensing assembly 14 in a manner that will be described in more detail below.

The catches 32 align with a chord that is offset from the diameter of a circular end wall 34 of the cap and intersects the diameter of an opening 42 that leads to a cartridge receptacle 38 (described below). The circular end wall 34 at an upper end of the cylindrical side wall 26, includes a valve seat recess 36 and, in the depicted embodiment, three openings, which will be described in more detail below. The cap 24 also includes a cartridge receptacle 38 that receives the pressure source for the beverage dispensing assembly 10. A cartridge receptacle opening 42, which is one of the three openings in the circular end wall 34, leads to a cavity that is defined by the cartridge receptacle. The cartridge receptacle 42 is offset from a rotational axis of the cap 24, i.e. the axis about which the cap 24 rotates to be screwed onto or removed from the threaded neck 22 of the bottle 16. The cartridge receptacle 38 is configured to receive a conventional 12 ounce $CO_2$ cartridge 44 In other embodiments, the cartridge receptacle 38 can take other configurations to allow it to receive pressurized gas cartridges, for example, nitrogen cartridges or $CO_2$ cartridges that have a different volume. The cartridge receptacle 38 is closed with the exception of the opening 42 in the circular end wall 36 so that the internal compartment of the cartridge receptacle is not in communication with the bottle 16 when the cap 24 is connected to the threaded neck 22.

The cap 24 also includes a beverage outlet passage 52 and a pressurized gas inlet passage 54, each of these passages being in communication with a separate opening, mentioned above, formed in the circular end wall 34. Each passage 52 and 54 extends through the cap 24 such that each passage is in communication with the internal volume of the bottle 16. Each passage 52 and 54 is sealed after the beverage manufacturer has filled the bottle 16 to transport the bottle from the manufacturer to the retailer. In one example, foil, or other sealing device such as rubber, plastic and the like, can act as a plug to block the passages 52 and 54 to prevent the egress of beverage from the bottle during shipment. In another example, valve assemblies, which will be described in more detail below, are used to seal the passages 52 and 54.

As mentioned above, the pressure source in the depicted embodiment is a conventional $CO_2$ cartridge 44 that fits into the cartridge receptacle 38. The type of cartridge used in the depicted embodiment is pierced in a manner that will be described later. A locking clip 56 retains the cartridge 44 in the cartridge receptacle 38. The locking clip 56 in the depicted embodiment includes a central opening that receives the neck portion of the cartridge and a peripheral portion that engages the side wall of the cartridge receptacle. The cartridge 44 can be retained in other manners.

With continued reference to FIG. 3, the beverage outlet valve assembly includes a plug 60 and a biasing member, such as a spring 62, that biases the plug into a closed position. The plug 60 acts against a seal 64 that is retained by a seal retainer 66 that both fit into the valve seat recess 36 formed in the circular end wall 34 of the cap 24. The seal retainer 66 is welded to the cap 24 in the present embodiment. The spring 62 and the valve plug 60 are positioned inside the beverage outlet passage 52 and the spring 62 urges the plug 60 towards the seal 64. The seal 64 includes a first opening 68 that aligns with the beverage outlet passage 52, Similarly, the seal retainer includes a first opening 70 that aligns with the first opening 66 and the seal 64 and the beverage outlet passage 52 in the cap 24. These openings 68 and 70 and the beverage outlet passage 52 are blocked when the plug 60 is moved into the closed position. As most clearly seen in FIG. 8, the beverage outlet passage 52 is stepped to allow the spring 62 to seat in the outlet passage 52 and bias the plug 60 towards the seal 64 thus blocking the beverage outlet passage 52. If desired, the spring can be removed and the plug 60 can be biased by the pressurized beverage in the bottle 16.

Figure 8:
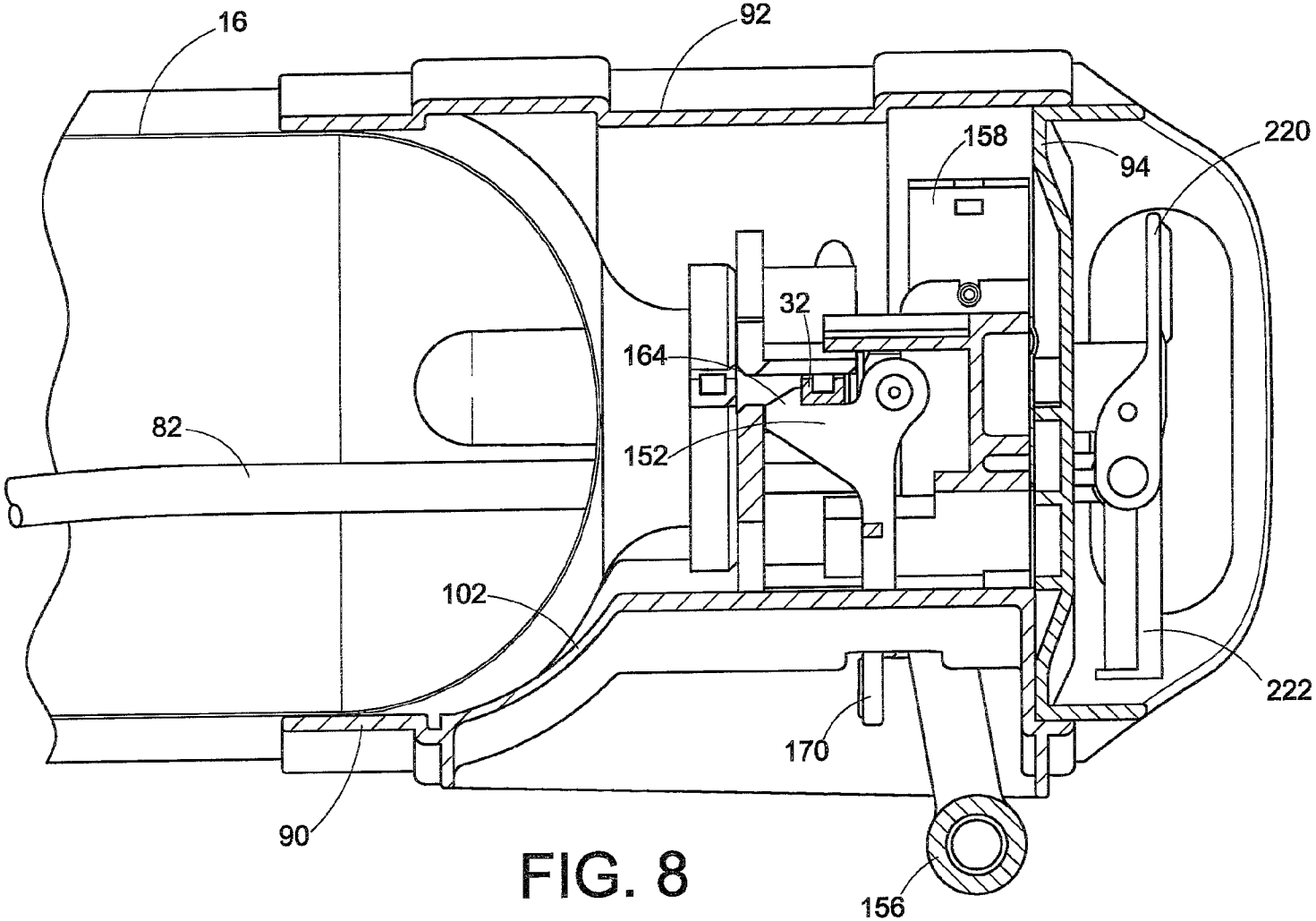

In a similar fashion, as seen in FIG. 3 the pressurized gas valve assembly includes a plug 72 that is biased by a spring 74 towards the seal 64. The seal 64 includes a second opening 76 that aligns with the pressurized gas inlet passage 54. The seal retainer 66 also includes a second opening 78,that aligns with both the second opening 76 in the seal 64 and the pressurized gas inlet 54 that is formed in the cap 24. The plug 72 seals against the seal 64 to prevent the beverage and gas from leaving the bottle 16 through the pressurized gas inlet 54 until the plug 72 is moved away from the seal. As seen in FIG. 8, the gas inlet passage 54 is also stepped to provide a seat for the spring 74. If desired, the spring can be removed and the plug 72 can be biased by the internal pressure of the pressurized beverage in the bottle.

A hollow flexible dip tube 82 attaches to the cap 24 and is communication with the beverage outlet passage 52. A dip tube weight 84 attaches at a distal end of the dip tube. The dip tube 82 extends from the cap 24 a length that is slightly greater than the length of the bottle 16 that is found below the threaded neck 22. Accordingly, the dip tube 82, which is made from a flexible material, can have a slight curvature such that the dip tube resides at a lower most location in the bottle to allow for full evacuation of the bottle 16 as beverage is dispensed from the bottle. In the depicted embodiment, the dip tube weight 84 is a ring that receives the dip tube. The dip tube weight can take alternative configurations and attach to the dip tube in alternative manners.

As discussed above, the cap assembly 18 retains the draft beverage in the bottle during shipment and includes components that allow for the dispensing of metered portions of a pressurized and/or carbonated beverage from the bottle 16. Some or many of the components depicted in the cap assembly can be placed in the dispensing assembly, for example the valve assemblies and the $CO_2$ cartridge. The usefulness of providing the valve assemblies in the cap 24, as opposed to putting these assemblies in the dispensing assembly 14, is if some beverage remains in the bottle 16, the bottle assembly 12 can still be removed from the dispensing assembly 14 because the plugs 60 and 72 are biased towards a closed position that prohibits the beverage and gas from leaving the bottle.

As discussed above, the dispensing assembly 14 receives the bottle assembly 12. The bottle assembly 12 is designed to be removed from the dispenser assembly 14 after the beverage has been dispensed, or earlier if desired, and replaced with a new bottle assembly. The dispenser assembly 14 includes more of the expensive components of the system and is designed to be reused with many different bottle assemblies.

Figure 4:
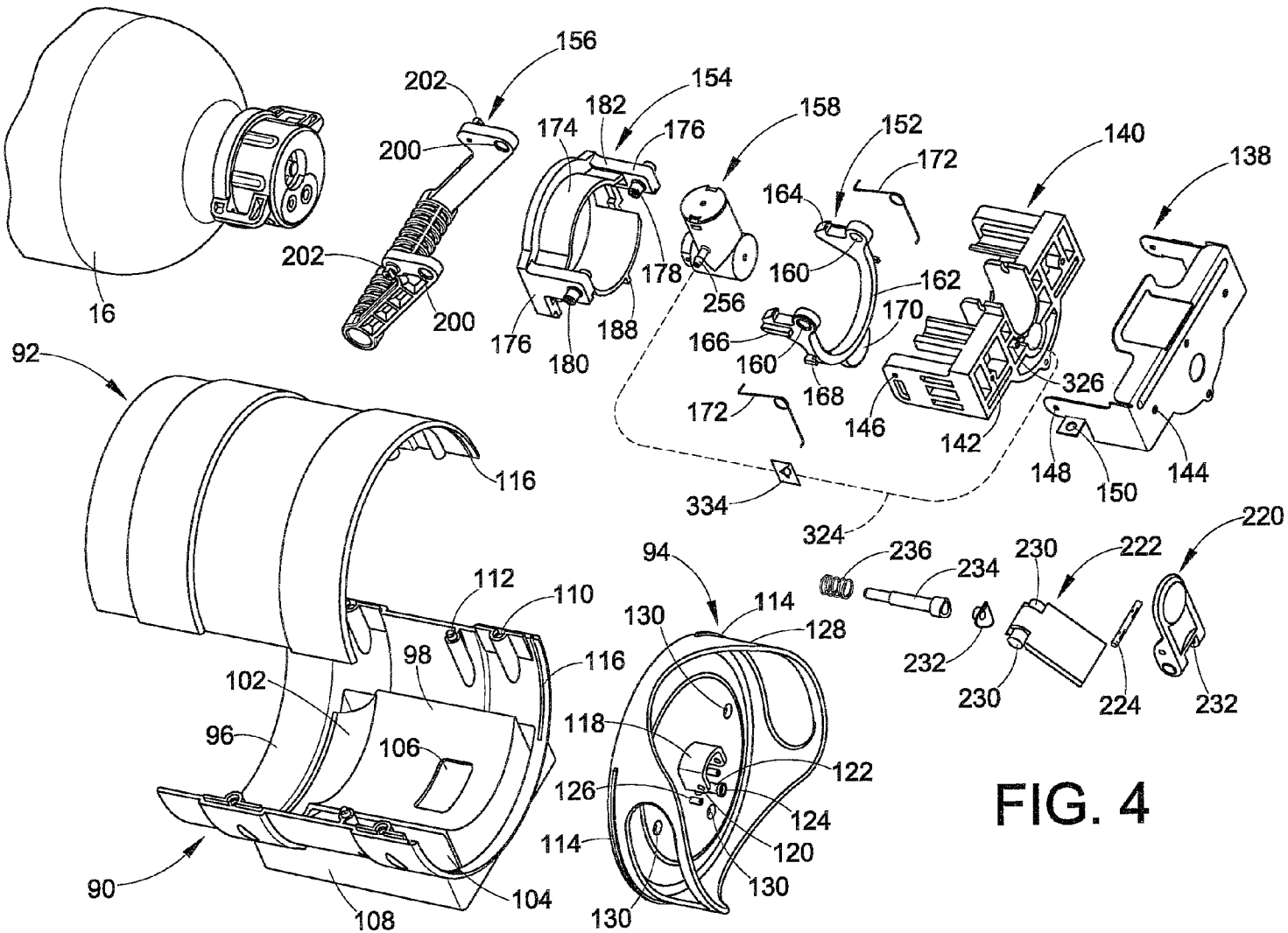
FIG. 4 is an exploded view of a dispensing assembly of the beverage dispensing assembly shown in FIG. 1.

With reference to FIG. 4, the dispensing assembly includes a housing, which in the depicted embodiment includes a base or lower housing 90, a lid or an upper housing 92, and a face plate or front housing 94. The housing portions 90, 92, and 94 attach to one another to form a generally cylindrical housing as seen in FIG. 1. The housing can take other configurations and can be made from a fewer or greater number of components. In the depicted embodiment the housing is made of a plastic material, but other materials can be used.

The lower housing is generally half-cylindrical and includes a curved base surface 96. A forward platform 98 begins at a location is axially spaced from a rear edge of the base housing (with respect to the front face 94) and extends towards the front edge of the base 90 to almost the front face 94 when the housing portions are connected to one another. The forward platform 98 is radially spaced from the base surface 96 and is also curved. A concave ramp 102 connects the inner base surface 96 to the forward platform 98. The ramp 102 has a curvature that is complementary to the curvature of the bottle 16 between its widest diameter portion and the threaded neck 22. As seen FIG. 8, for example, the portion of the bottle where its diameter progressively decreases towards the threaded neck 22 abuts against the ramp 102 when the bottle assembly 12 is fully inserted into the dispensing assembly 14.

The forward platform 98 is also separated from the inner base surface 96 by openings 104 (only one is visible in FIG. 4) on each side of the platform that is generally parallel to a central axis of the housing. The forward platform 98 also includes a central generally rectangular opening 106. Each of the openings 104 and 106 allows for components that allow for the mounting of the bottle assembly 12 into the dispensing assembly 14 to be accessible by the consumer. These components will be described in more detail below.

The base housing 90 also includes an integral base 108 extending downwardly that provides a planar support surface for the beverage dispensing assembly 10. The planar support surface is slightly inclined so that the rearward portion of the bottle 16 is lower than the forward portion of the bottle to allow the beverage to puddle towards the inlet of the dip tube 82 to promote full evacuation. Fastener openings 110 are provided in the base housing 90 for attaching the lid 92 to the base housing. The base housing 90 can attach to the lid in other conventional manners. Also, support posts 112 are formed in the base housing 90, the function of which will be described below.

The lid 92 is generally half-cylindrical in shape. It includes a plurality of fastener openings (not visible) that align with the fastener openings 110 in the base housing 90 to attach the lid to the base housing. When the lid 92 is attached to the base housing 90 the diameter of the housing is slightly larger than the maximum diameter of the bottle 16, see for example FIG. 7.

The face plate 94 is sandwiched between the base housing 90 and the lid 92. In the depicted embodiment, the face plate includes ridges 114 that are received in notches 116 formed in the base housing 90 and the lid 92 that fix the face plate in an axial direction. The face plate 94 also includes an external mounting extension 118 that extends outwardly from and is generally centrally located in the face plate. The mounting extension 118 has a generally upside-down U-shaped configuration and includes aligned pin openings 120 on each side of the U-shape. The face plate 94 also includes a generally centrally located boss 122 that defines a passage 124 through which components involved in beverage dispensing extend, which will be described in more detail below. Small posts 126 are positioned on opposite sides of the boss 122 and are generally aligned with one another. The face plate 94 also includes handles 128 extending outwardly from the face plate on opposite sides of the face plate and a plurality of fastener openings 130 that extend through the face plate.

Figure 5:
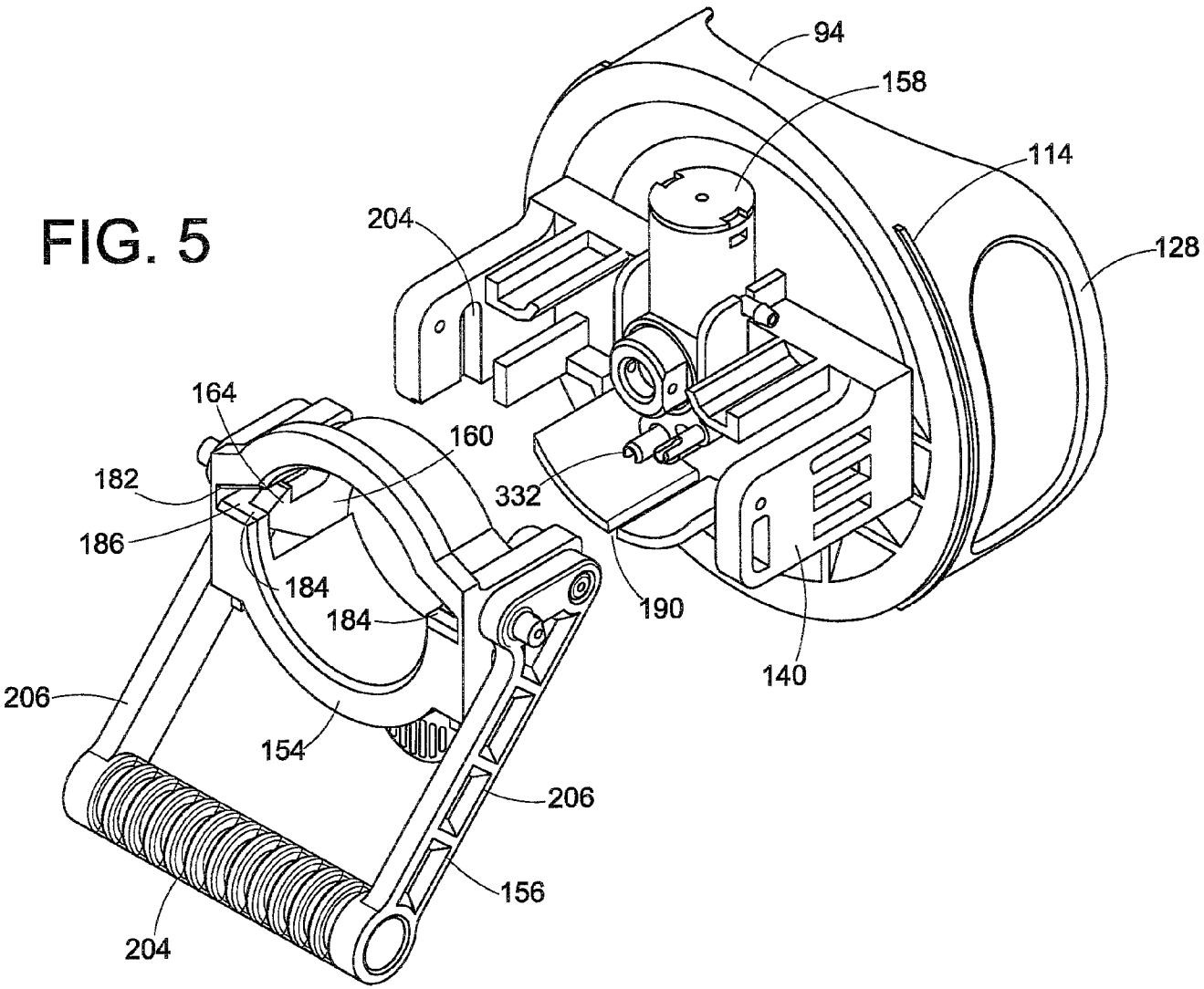
FIG. 5 is a perspective view of a locking lever, an alignment bracket and a bottle retainer assembled together and removed from a frame of the dispensing assembly depicted in FIG. 4.

The fastener openings 130 in the face plate 94 allow for the attachment of a frame cover 138 and a frame 140 against an inner surface of the face plate, as seen in FIG. 5. The frame 140 includes a plurality of fastener openings 142 that align with fastener openings 144 in the frame cover 138 and fastener openings 130 the face plate 94 to receive fasteners (not shown) for attaching the frame and frame cover to the face plate. The frame 140 includes additional fastener openings 146 that align with fastener openings 148 in the cover 138 to attach the two together. The frame cover 138 also includes openings 150 that receive support posts 112 to fix the cover and the frame 140 in the housing. The frame 140 provides a support for components of the dispenser assembly 14 that provide the connection between the bottle assembly 12 and the dispenser assembly 14.

A bottle retainer 152, an alignment bracket 154, and a locking lever 156 cooperate with the frame 140 to connect the bottle assembly 12 to the dispensing assembly 14. A pressure regulator 158, which will be described in more detail below, also cooperates with the frame 140, the bottle retainer 150, the alignment bracket 152 and the locking lever 154.

The bottle retainer 152 in the depicted embodiment includes a generally U-shaped member 162 with openings 160 formed at opposite ends. The openings 160 provide a means for attaching the bottle retainer 152 to the alignment bracket 154. Catches 164 extend from each end of the U-shaped member 162 near the openings 160 towards the alignment bracket 154. Ridges 166 extend from the outer side of the bottle retainer between the end of each catch 164 and each opening 160. Also, spring catches 168 are formed underneath each opening on the U-shaped member. A tab 170 extends downwardly from the center of the U-shaped member 162, which is the lower most portion of the bottle retainer 152 as depicted in FIG. 4. Springs 172 bias the bottle retainer in a rotational direction towards the bottle assembly 12.

The alignment bracket 154 in the depicted embodiment includes a circular section 174,and two appendages 176 extending from diametrically opposite sides of circular section 174 towards the bottle retainer 152 when finally assembled. A first pair of inwardly extending axle posts 178 extend towards each other from each distal end of each appendage 176. Each axle post 178 is received in a respective opening 160 of the bottle retainer 152. A second pair of axle posts 180 extend outwardly from each appendage 176 and are generally coaxial with the first axle posts 178.

The circular section 174 of the alignment bracket 154 is configured to receive the circular cap 24 that connects to the bottle 16. Outer ends of an upper portion of the circular section 174 form upper and lower alignment surfaces 182 and 184, respectively, extend inwardly from each appendage 176 and towards the bottle retainer 152 to define a channel 186 (FIG. 5) that receives the catches 32 formed in the cap. The lower alignment surfaces 184 do not extend along the central axis of the circular section 174 as great a distance as compared to the upper alignment surfaces 178 (see FIG. 5), which allows the catches 164 of the bottle retainer 152 to engage the catches 32 on the cap 24, in a manner that will be described in more detail below. The alignment bracket 154 also includes a lower downwardly extending ridge 188 aligned with a central axis of the circular section 170 that is received in linear notch 190 formed in the frame 140. Both the alignment bracket 154 and the bottle retainer 152 are configured to move linearly with respect to the frame 140 in a manner that will be described in more detail below.

The locking lever 156 is also generally U-shaped in configuration and includes openings 200 that receive respective mounting posts 180 of the alignment bracket 154. The locking lever 156 also includes outwardly protruding posts 202 that are received in vertical slots 204 (FIG. 5) formed in the frame 140. The posts 202 include a flattened section so that the posts 202 lock into a locked position or an unlocked position when a hand grip 204, which is disposed between two appendages 206 that include the openings 200 and the mounting posts 202, is moved from an unlocked position toward a locked position, which will be described in more detail below.

With reference to FIG. 4, the dispensing assembly 14 also includes a tap handle 220 and a spout 222 that each attach to the face plate 94 of the housing. The tap handle 220 is rotated with respect to the face plate 94 to dispense a metered portion of a pressurized beverage from the bottle 16 through the spout 222. The tap handle 220 attaches to the mounting extension 118 of the face plate 94 via a pin 224 that is received in openings 226 in the tap handle and in the openings 120 provided in the mounting extension 116 on the, face plate 94. The spout 222 is formed to include hubs 230 that are received in receptacles 232 formed in the tap handle 220.

The tap handle 220 and the spout 222 cooperate with a hollow seal 232, a beverage valve actuator 234 and a spring 236 to dispense metered portions of a beverage from the bottle 16 in a manner that will be described in more detail below.

As discussed above, the beverage dispensing assembly 10 is capable of providing pressurized gas to the bottle 16 so that the contents of the bottle stay fresh over an extended period of time. The gas pressure also propels the beverage. The pressure regulator 158 that is shown above cooperates with the pressure source found in the cap assembly 18 to provide pressurized gas to the inside of the bottle. The pressure regulator 158 receives gas at a first pressure from the pressure source and delivers at a second pressure, which is lower than the first pressure, to the bottle 16.

Figure 6:
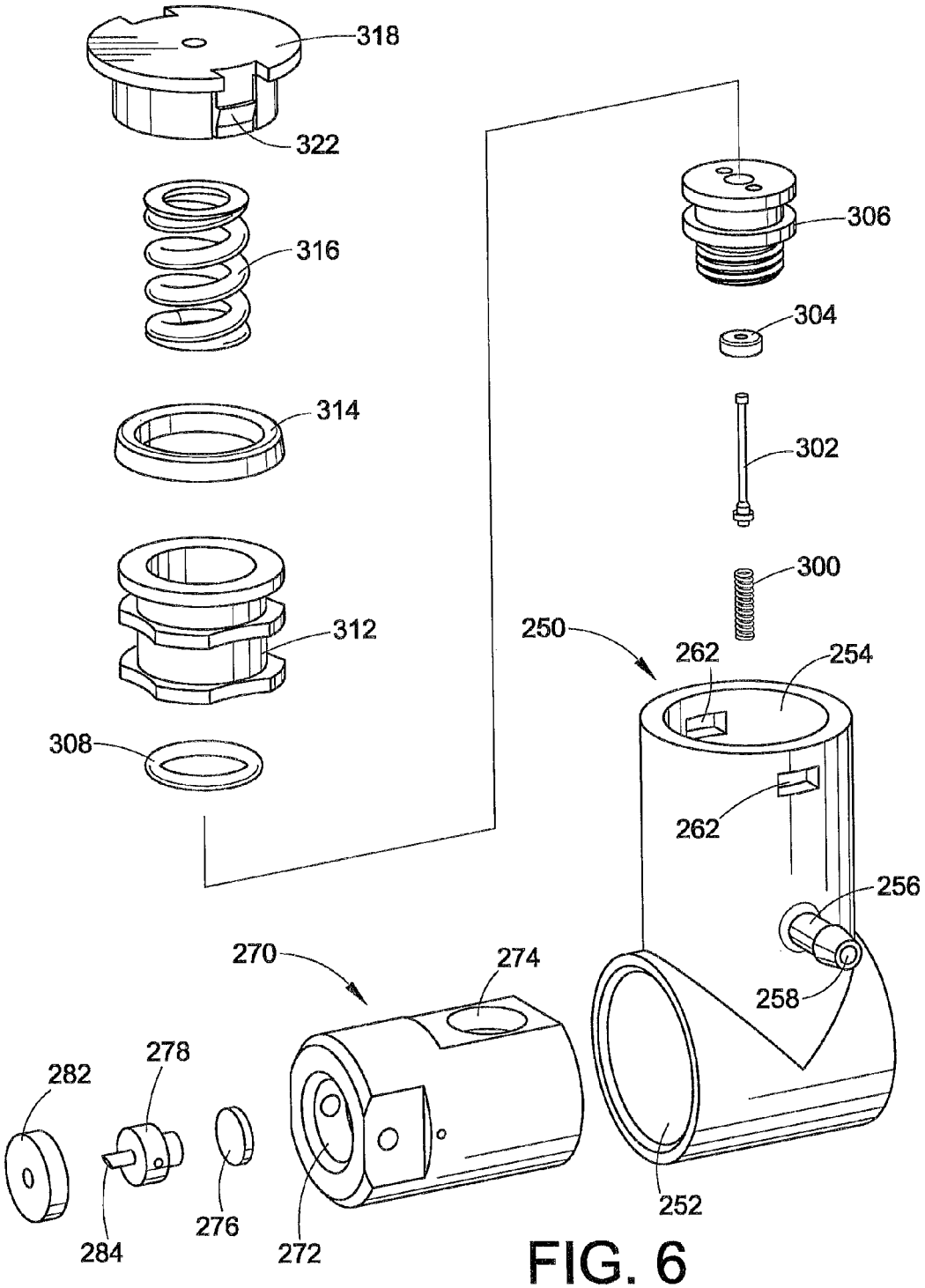
FIG. 6 is an exploded view of a regulator of the dispensing assembly that is shown in FIG. 4.

With reference to FIG. 6, the regulator 156 includes a regulator body 250 that includes a first (horizontal) cylindrical opening 252 having a symmetrical axis extending along a first direction and a second (vertical) cylindrical opening 254 that is communication with the first cylindrical opening 252 and includes a symmetrical axis that is perpendicular to the symmetrical axis of the first cylindrical opening. A nipple 256 extends from the regulator body and includes a passage 258 that is in communication with the vertical passage 254 in the regulator body. The regulator body 250 also includes two rectangular openings 262 that are diametrically opposed from one another and disposed adjacent an upper end of the vertical opening 254.

The horizontal cylindrical opening 252 receives a piercing mechanism housing 270. The piercing mechanism housing 270 includes a generally horizontal cylindrical passage 272 that connects with a generally vertical cylindrical passage 274. The vertical passage 274 in the piercing mechanism housing 270 aligns with the vertical passage 254 of the regulator body 250 when the piercing housing mechanism 270 is received in the horizontal passage 252. In the depicted embodiment, internal threads are provided in the vertical passage 274 of the piercing mechanism housing 270.

Figure 14:
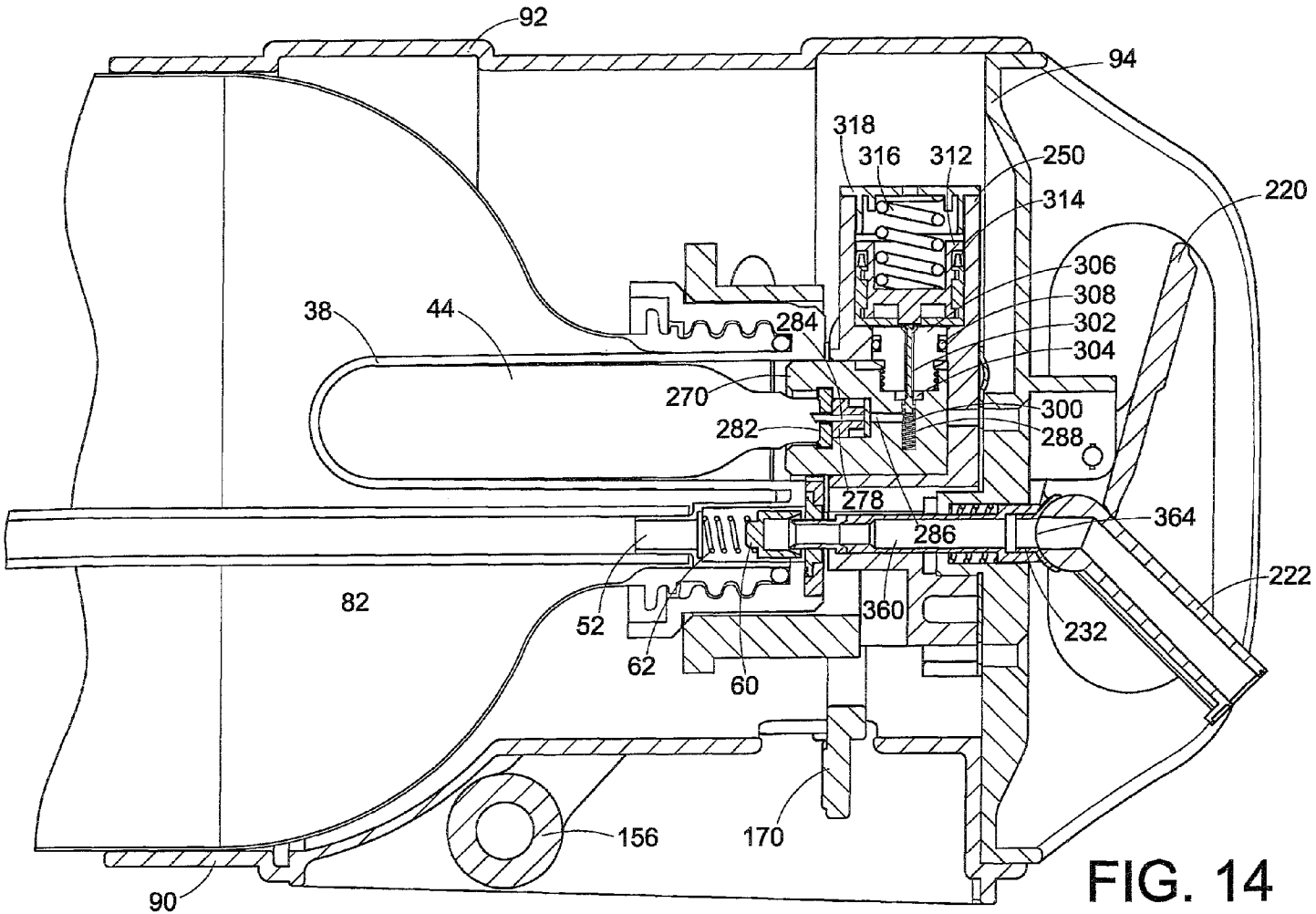

The piercing mechanism housing 270 receives a filter 276, a piercing pin 278, and gasket 282 in the horizontal passage 272. The piercing pin 278 is hollow and includes a passage 284 extend through the piercing pin that communicates with a smaller horizontal passage 286 in the piercing mechanism housing 270 and a smaller vertical passage 288 in the piercing mechanism housing 274 (FIG. 14). The piercing pin 278 also includes a sharp edge that extends outwardly from the piercing mechanism housing 270 so as to pierce the pressurized gas cartridge 44 (FIG. 3) in a manner that will be described in more detail below.

The vertical passage 254 in the regulator body 250 receives a small spring 300, a valve pin 302, a valve seal 304, a plug 306, an O-ring 308, a piston 312, a piston seal 314, a larger spring 316 and a cap 318. With reference to FIG. 14, the spring 300 is received in the smaller vertical passage 288 of the piercing mechanism housing 270. A lower portion of the valve pin 302 is also received in the vertical opening 288. The valve seal 304 includes an opening for receiving the valve pin, as does the plug 306. The plug 306 includes a threaded portion that is threaded into the larger vertical opening 274 of the piercing mechanism housing 270. An O-ring 308 surrounds the plug 306 and contacts a circular side wall of the regulator body 250.

The cap 318 includes a pair of resilient tabs 322 that snap into the rectangular openings 262 of the regulator body 250. The larger spring 316 biases the piston 312 downwardly in the piston seal contacts an outer surface of the piston 312 and an inner surface of the regulator body 250.

Pressurized gas (under high pressure—about 850 psig) exits the cartridge 44 through the passage 284 and into the smaller horizontal passage 286 of the piercing mechanism housing 270. The spring 300 biases the valve stem 302 against the seal 304 closing the vertical passage through the plug 306. Lower pressure ($P_L$), which is equal to the pressure of the beverage in the bottle 16 (about 16 psig, but can be anywhere between about 5 psig to about 35 psig) is in a chamber defined above the O-ring 308. After some of the beverage has been dispensed (or at the initial charge), the pressure above the O-ring 308 drops below $P_L$. The upper spring 316 then biases the piston 312 which presses down on the valve stem 302 unseating the valve stem from, the seal 304. Gas then moves through the passage in the plug 306 and out the nipple 256 until $P_L$ is again reached above the O-ring 308, which moves the piston 312 against the spring 316. A hose 324 (depicted schematically in FIG. 4), attaches to a corresponding nipple 326 formed in the frame 140 having an internal passage 328 (FIG. 9) to deliver pressure at or about $P_L$ to the bottle, A rearwardly extending hollow cartridge spike 332 extends from the frame 140 and is received in the gas inlet passage 54 to provide pressurized gas to the internal volume of the bottle 16. The rearwardly extending hollow spike 332 also defines a portion of the passage 328 that is defined by the nipple 326 on the frame 140. A check valve 334 (depicted schematically in FIG. 4) is provided in the circuit between the pressure regulator 156 and the internal volume of the bottle 16. The check valve 334 prevents the beverage from flowing into the regulator when the pressure just downstream of the outlet of the nipple 256 on the regulator 158 is in equilibrium with the pressure inside the bottle 16. The check valve 334 is configured to open when there is about 2 psi to about 3 psi pressure differential across the check valve. In the depicted embodiment the check valve is a duck bill type check valve with the bill being disposed towards the bottle 16 in the circuit.

Figure 7:
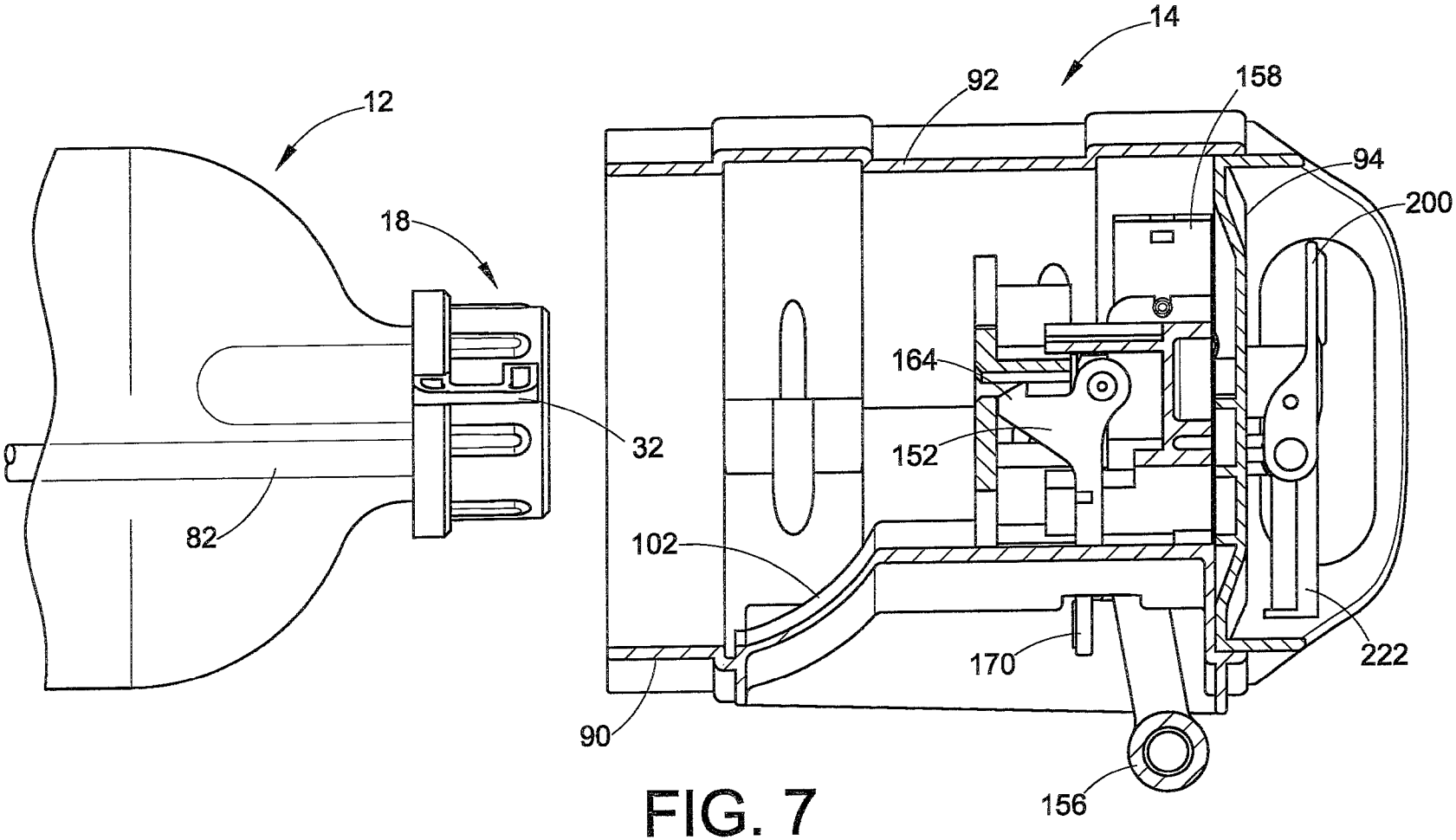
FIGS. 7-15 depict the steps involved in loading the bottle assembly into the dispensing assembly, dispensing beverage and removing the empty bottle assembly.

The operational sequence of the beverage dispensing assembly 10 will be described in more detail with reference to FIGS. 7-15. With reference to FIG. 7, the bottle assembly 12 is advanced into the dispenser assembly 14 by the consumer. With reference to FIG. 8, as the bottle assembly 12 is advanced towards the front plate 94 of the dispenser housing, the bottle retainer 152 rotates counter clockwise under spring pressure until the bottle assembly is fully advanced. The bottle retainer 152 then rotates back clockwise so that the catches 164 on the bottle retainer cooperate with the catches 32 on the cap 24 to retain the cap 24 and thus the bottle assembly 12. The locking lever 156 is shown in the unlocked position in FIG. 8.

Figure 9:
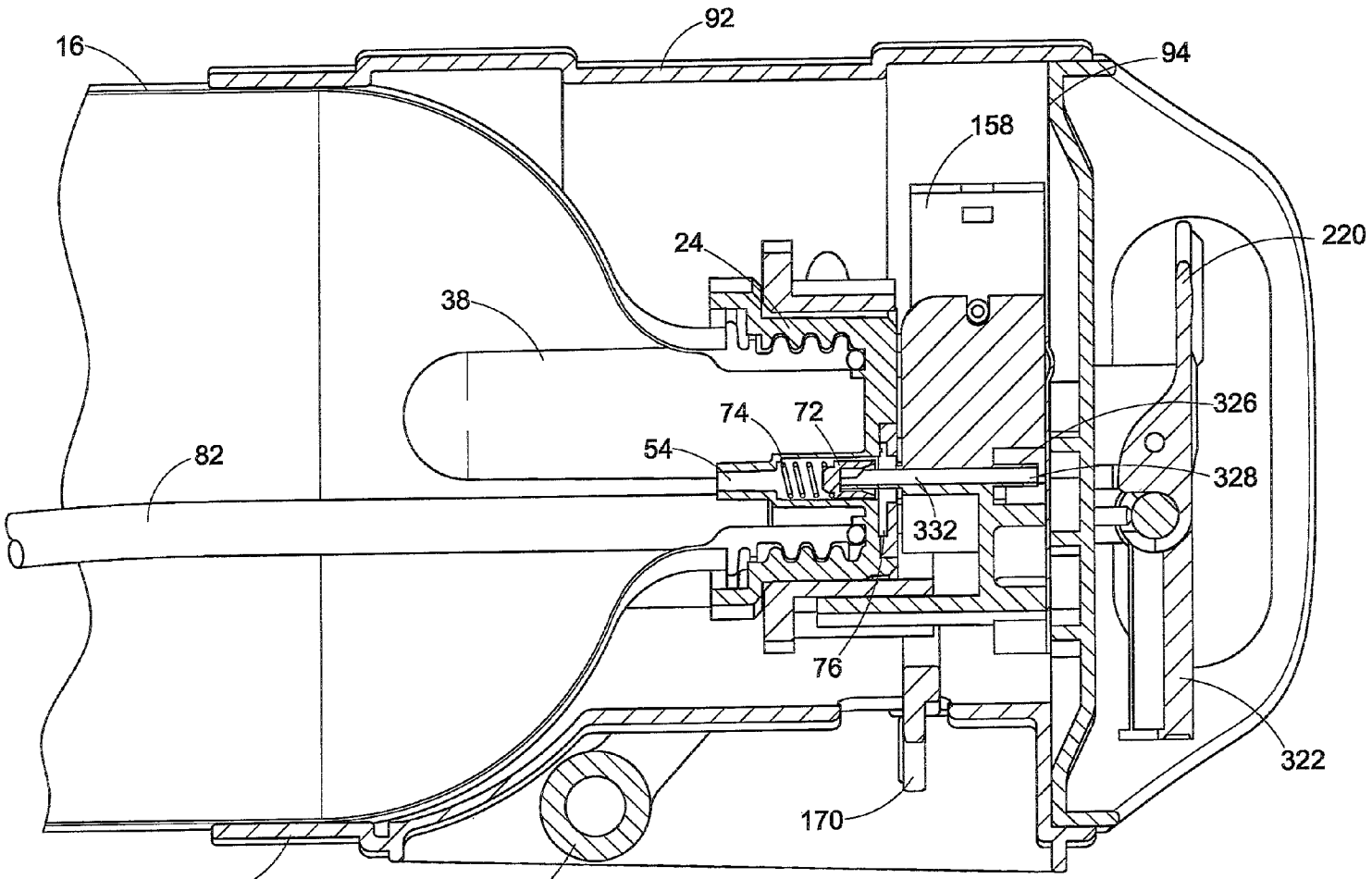

With reference to FIG. 9, the locking lever 156 is advanced from the unlocked position to a locked position. The cartridge spike 332 advances into the gas inlet passage 54 formed in the cap 24 and opens the corresponding gas valve assembly by displacing the gas valve plug 72 from the seal 76. Accordingly, pressurized gas from the $CO_2$ cartridge 44 can enter the internal volume of the bottle 16.

Figure 10:
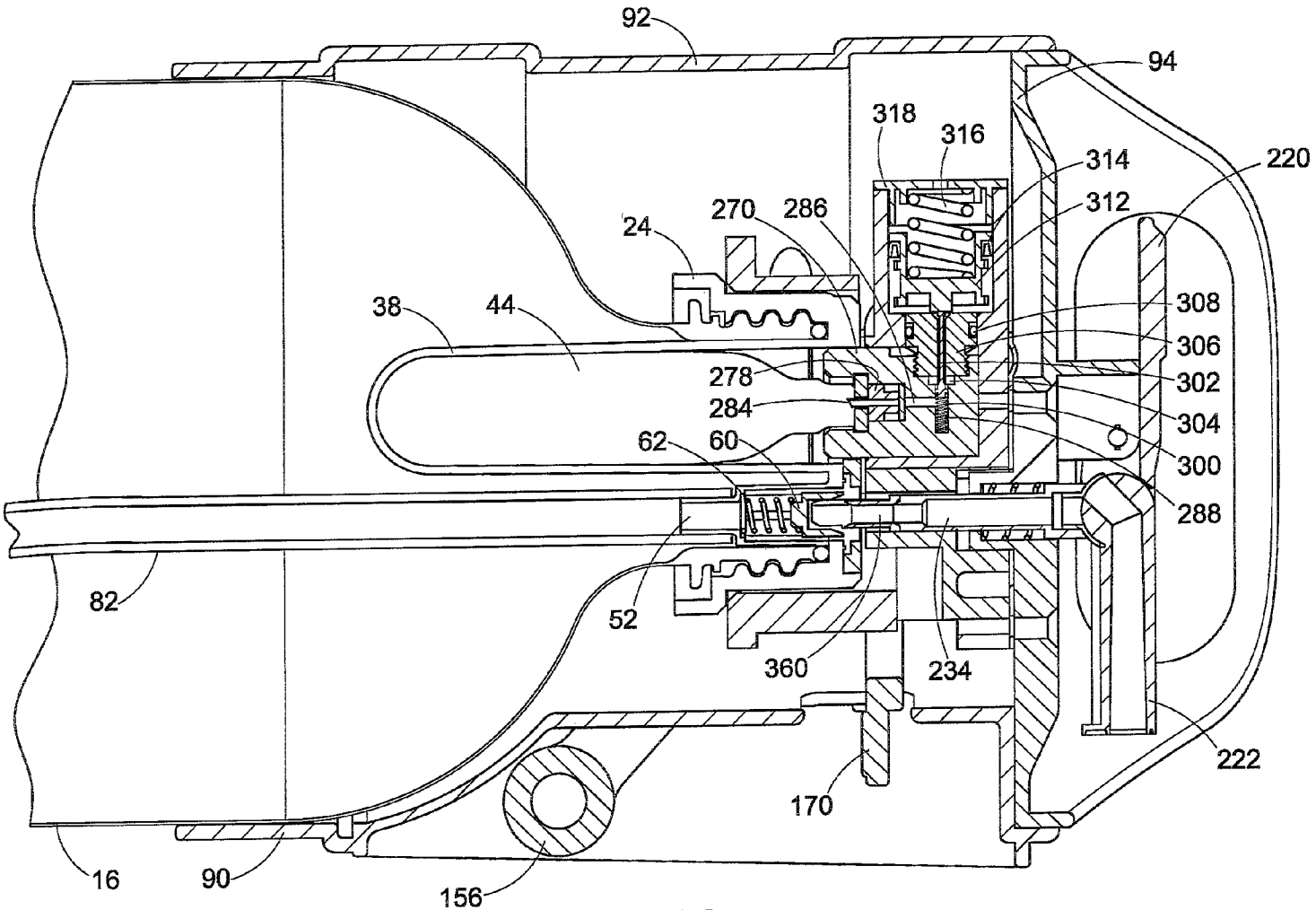

With reference to FIG. 10, which shows the same operational state as that shown in FIG. 9, when the locking lever 156 is moved from the unlocked position (shown in FIG. 8) to the locked position, the pointed edge 284 of the piercing pin 278 punctures the cartridge 44, thus providing communication between the cartridge 44 and the inside of the bottle 16. As also seen in FIG. 10, the beverage valve actuator 234, which is hollow and includes a passage 360 is inserted into the beverage outlet passage 52; however, the beverage outlet valve assembly is still in the closed position. The beverage valve actuator 234 also acts as a spike to unseal the beverage outlet passage 52.

Figure 11:
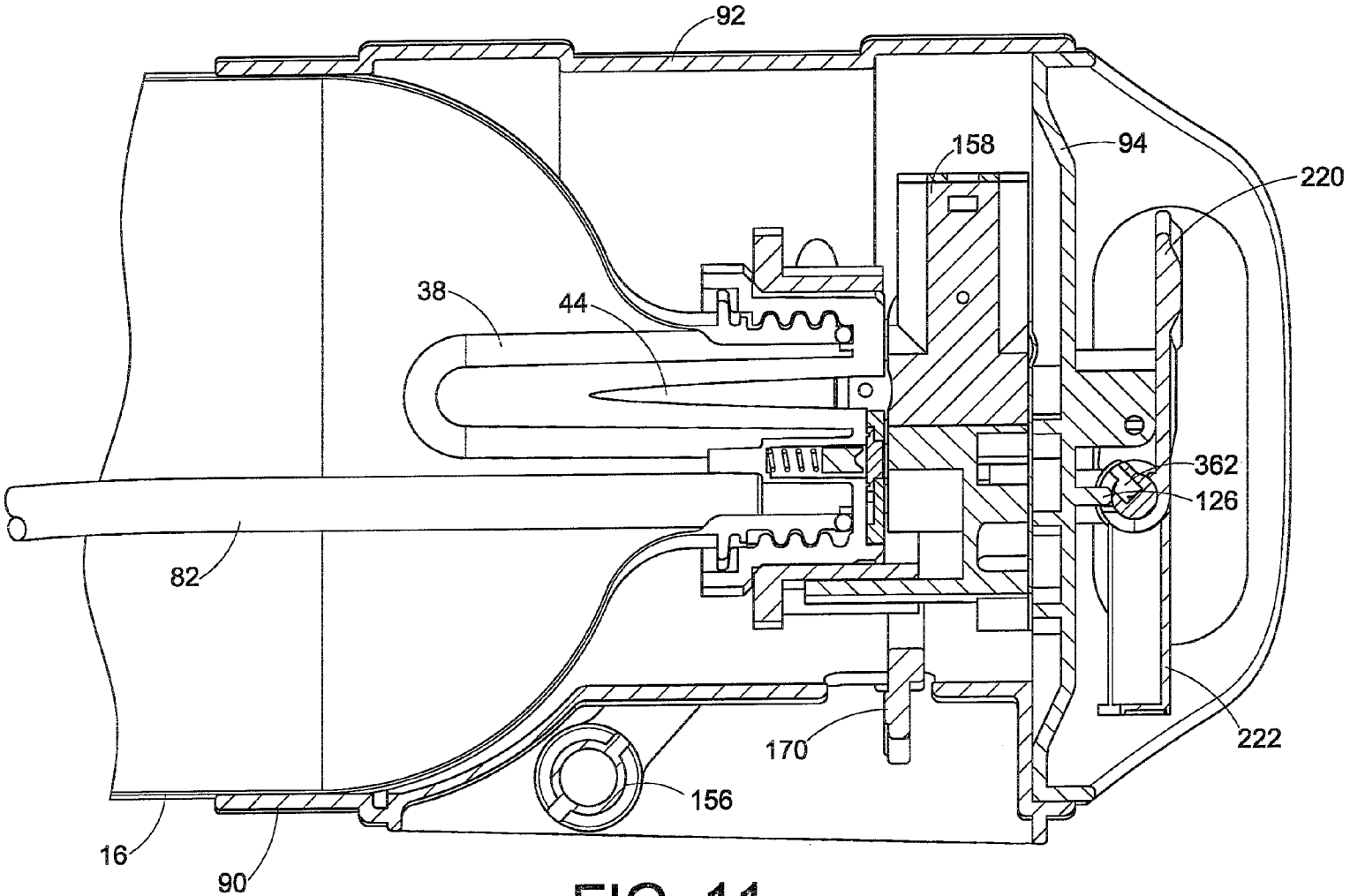

FIG. 11 shows the same state as FIGS. 8 and 9 while showing the spout 222 in a locked position. With the spout in the locked position, the tap handle 220 can not be rotated until the spout 222 is rotated outward (i.e. counterclockwise). Rotating the spout 222 outward aligns the pins 126 (also seen in FIG. 4) with channels 362 formed in the spout 222, thereby allowing the tap handle 220 to push the spout 222 towards the bottle cap 24.

Figure 12:
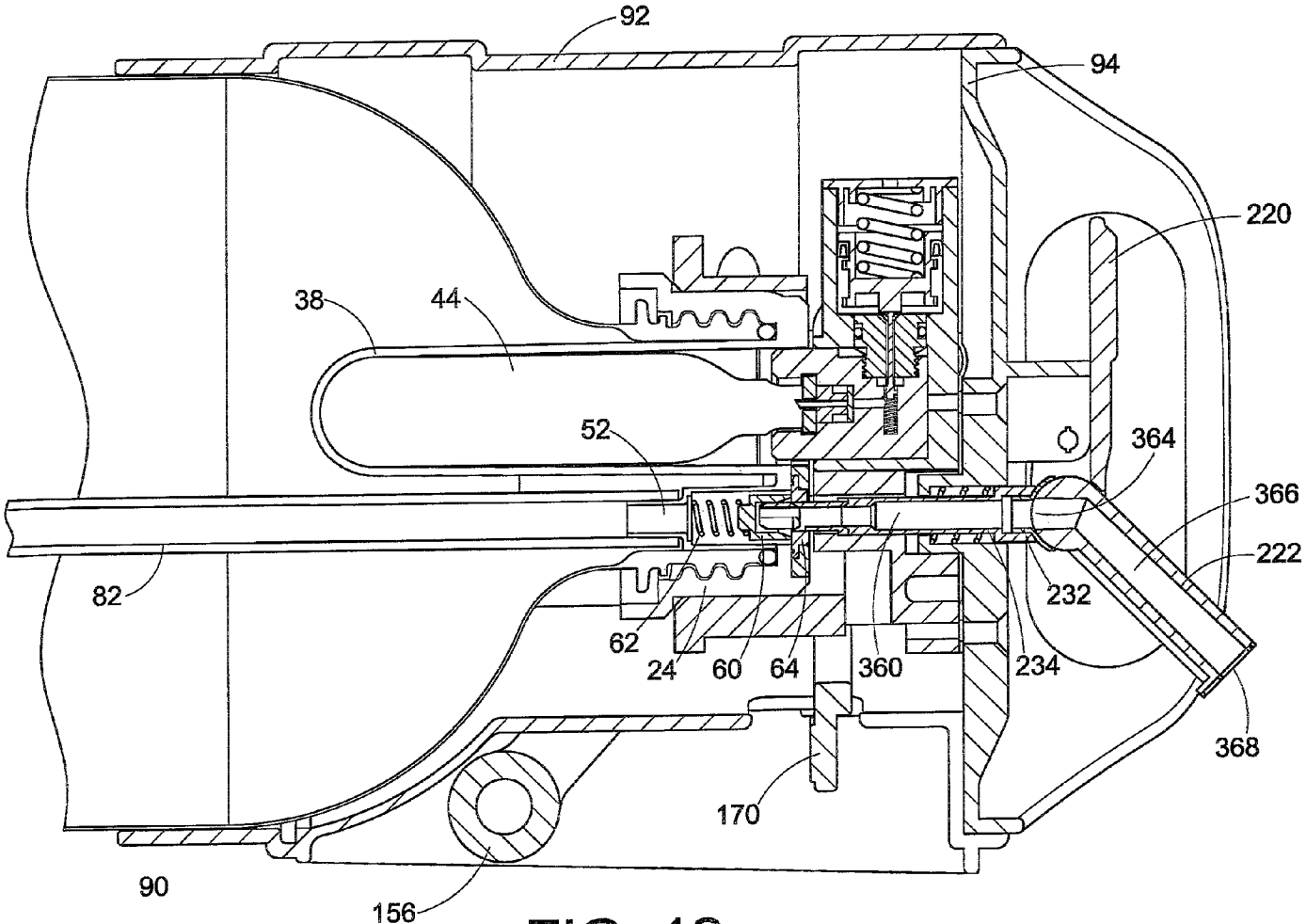
Figure 13:
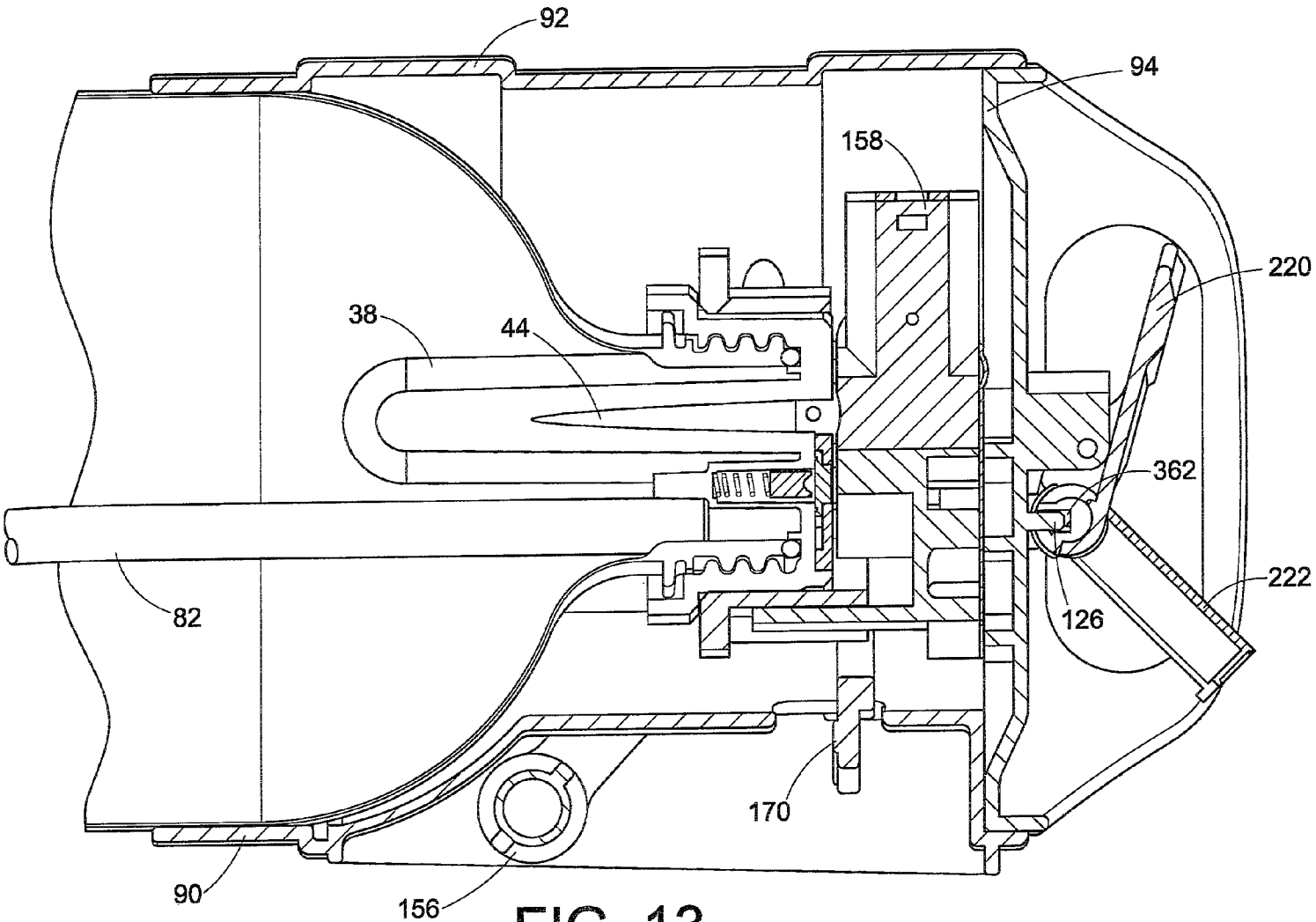

With reference to FIG. 12, the spout 222 has been rotated outward resulting in alignment of the beverage passageways. The passageway 360 defined in the beverage valve actuator 234 aligns with a beverage inlet 364 that is communication with a beverage passageway 366 and a beverage outlet 368 all formed in the spout 222. With reference to FIG. 13, the tap handle 220 is rotated clockwise to the dispense position resulting in the translation of the spout 222 and the beverage valve actuator 234 (FIG. 12) towards the bottle cap 24. The beverage valve assembly disposed in the cap is opened allowing beverage to flow under pressure from the bottle 16 to the spout 222. As shown in FIG. 13, the channel 362 in the spout 222 aligns with the pins 126 that extend outwardly from the face plate 94. With reference to FIG. 12, the beverage valve actuator 234 is translated towards the bottle cap 24 such that the plug 60 is moved away from the seal 64 opening the valve assembly allowing beverage to flow from inside the dip tube 82 through the beverage outlet passage 52 into the passage 360 formed in the beverage valve actuator 234 and into the beverage inlet 364 through the passage 366 and out the beverage outlet 368 of the spout 222.

Figure 15:
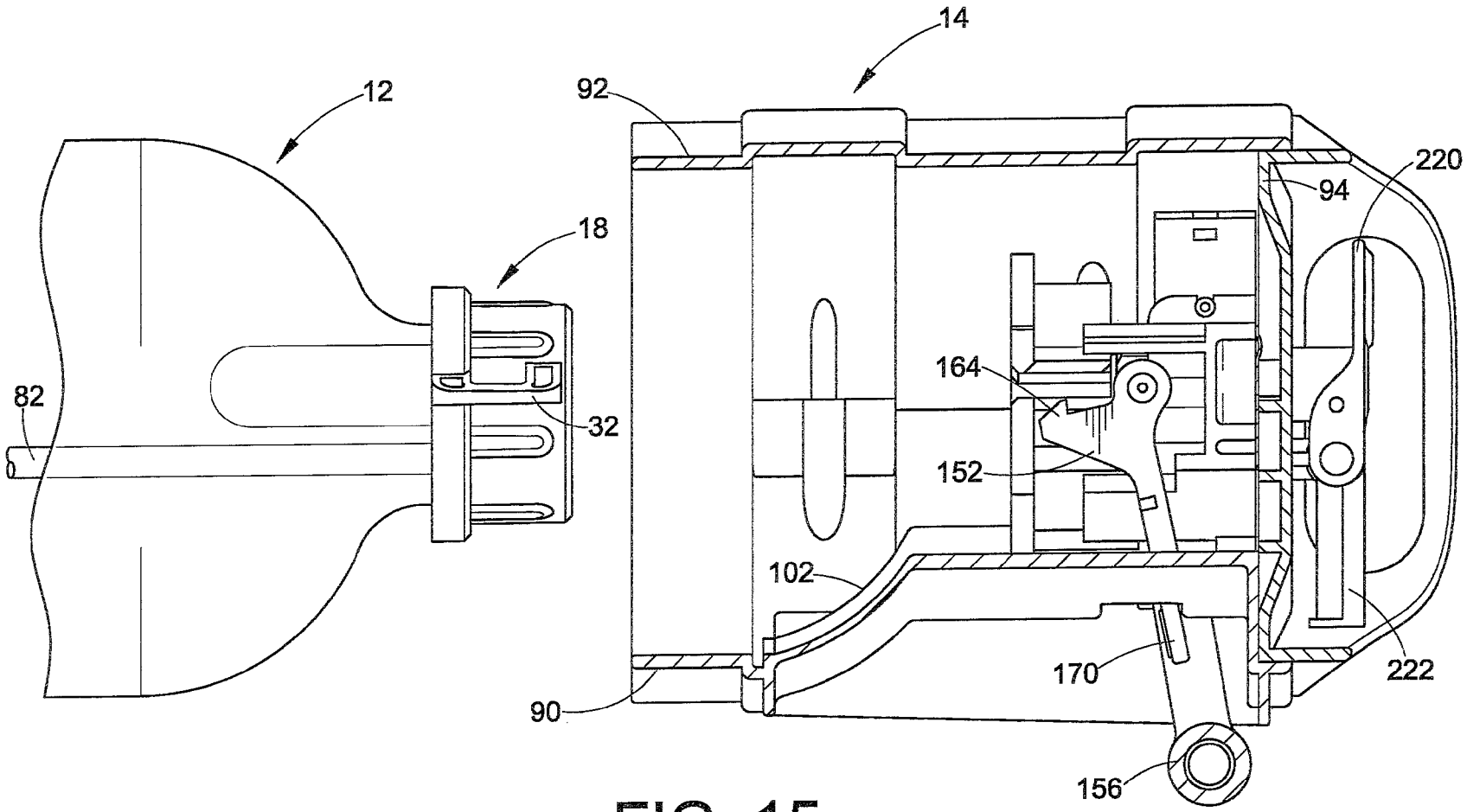

With reference to FIG. 15, when the contents of the bottle 16 have been fully dispensed or if a consumer simply wishes to remove the bottle assembly 12 from the dispenser assembly 14, the locking lever 156 is moved back into the unlocked position and the bottle retainer 152 is rotated counter clockwise by the consumer depressing the tab 170 so that the bottle assembly 12 can be removed from the dispenser assembly.

Figure 16:
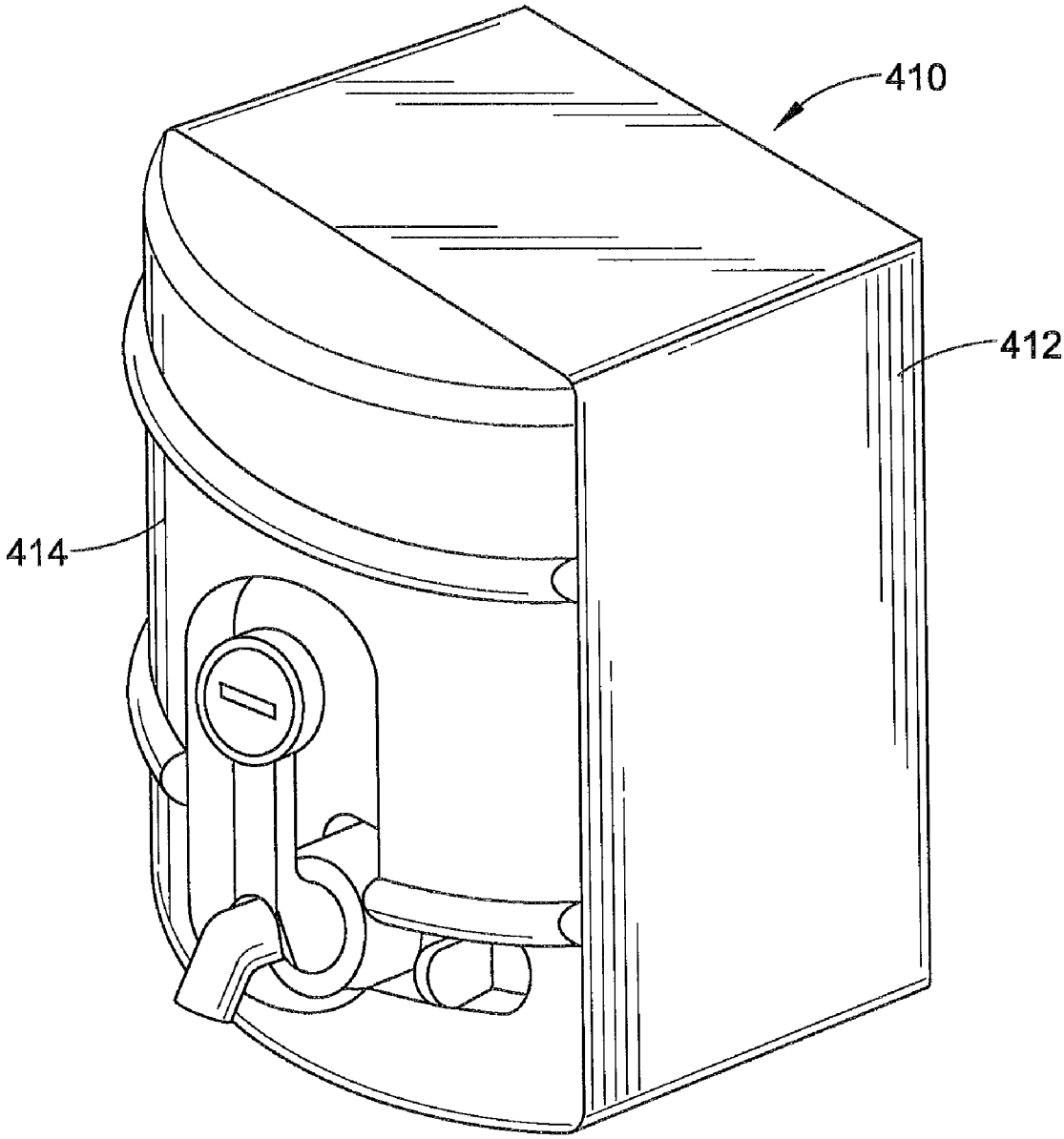
FIG. 16 is a perspective view of-an alternative embodiment of a beverage dispensing assembly.
Figure 17:
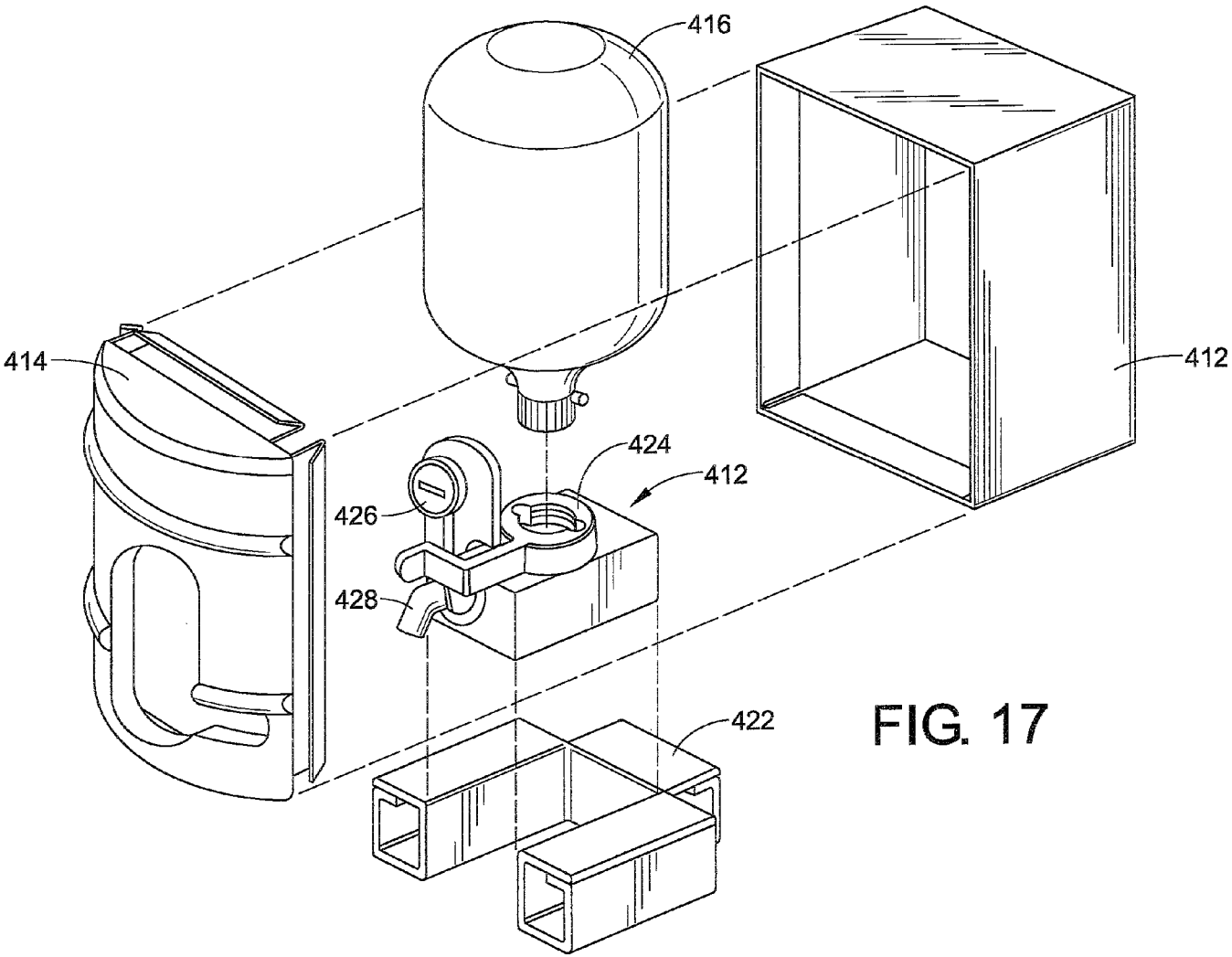
FIG. 17 is an exploded view of the assembly shown in FIG. 16.

FIGS. 1-15 depict only one example of a beverage dispensing assembly with great particularity. Alternative embodiments were discussed throughout the description. The invention is not limited to simply the embodiment discussed above. For example, the beverage dispensing assembly 410 is shown in FIGS. 16 and 17. The beverage dispenser assembly includes a housing having a rear box-shaped portion 412 and cover 414. As seen in FIG. 17, the housing encloses a bottle for 416, a dispenser mechanism for 18, and a spacer 422. The bottle 416 can be a blow molded bottle similar to the one described above. The dispenser mechanism 412 includes a pressure source such as a cartridge similar to the cartridge 44 described above. A rotatable lock assembly 424 can be provided on the dispenser mechanism to prevent accidental dispensing of the product and to prevent dispensing of the product during shipment. A tap handle 426 and a spout 428 that are similar to those described above can also be provided with a dispenser mechanism for 418.

To dispense the beverage, the locking mechanism 424 is rotated which allows the bottle 416 to drop onto the dispenser mechanism which results in a seal that caps the bottle to be broken and a seal on the pressure cartridge to also be broken. This would result by gravity because of the weight of the beverage being contained in the bottle 416. The tap handle 426 can actuate a valve to allow for selective dispensing of beverage through the spout 428.

A beverage dispensing assembly and system has been described with reference to particular embodiments. Many modifications and alterations will occur to those after reading the detailed description. The invention is not limited to only those embodiments that are disclosed above. Instead, the invention is broadly defined by the appended claims and the equivalents thereof.

The invention claimed is:

1. A system for dispensing servings of a beverage charged with a gas, the system comprising:

a bottle assembly including a bottle and a cap assembly, the bottle including a neck defining an outlet and containing multiple servings of a beverage, the cap assembly including a cap configured to attach onto the neck of the bottle to close the bottle, a sealed pressurized gas cartridge received in the cap, a beverage valve in the cap for allowing beverage to leave the bottle and a gas valve for allowing pressurized gas to enter the bottle; and a dispensing assembly, separable from the bottle assembly and disposed to receive and cooperate with the bottle assembly to dispense the beverage from the bottle, the dispensing assembly including a housing that receives the bottle and the cap assembly, a piercing pin arranged in the housing to pierce the pressurized gas cartridge in the cap upon insertion of the bottle assembly into the housing, a spout in fluid communication with the beverage valve for dispensing fluid from the bottle, and a pressure regulator in fluid communication with the pressurized gas cartridge and the gas valve, the pressure regulator including a regulating valve assembly for receiving pressurized gas from the pierced pressurized gas cartridge and delivering pressurized gas back through the cap to the bottle through the gas valve through an inlet passage spaced from an outer surface of the cap assembly and the gas cartridge whereby contaminants therefrom are avoided from being translated into the beverage.

2. The system of claim 1, wherein the bottle assembly connects to the dispensing assembly such that the housing and the bottle are dimensioned to be received inside of and fit onto a shelf of an associated conventional household refrigerator.

3. The system of claim 2, wherein the bottle and the housing have a maximum dimension measured parallel to a longitudinal axis of the bottle when the bottle is received in the housing that is less than about 40 cm.

4. The system of claim 1, wherein the bottle assembly further comprises a dip tube extending from the cap into the bottle and in fluid communication with the beverage valve, the dip tube being configured to allow for at least nearly 100% evacuation of the beverage from the bottle when the bottle is disposed either in a horizontal orientation or in a vertical orientation.

5. The system of claim 4, wherein the dip tube is flexible and the bottle assembly further comprises a weight connected to the dip tube.

6. The system of claim 1, wherein the pressurized gas cartridge received in the cap is also disposed within the bottle.

7. The system of claim 1, wherein the bottle comprises a blow molded plastic bottle between about one liter and about five liters in internal volume.

8. The system of claim 1, wherein the dispensing assembly includes a retainer configured to engage catches formed in the cap to retain the bottle with respect to the housing.

9. The system of claim 1, wherein the cap is threaded onto the bottle.

10. A disposable container assembly for use with a dispensing assembly that dispenses beverage under pressure, the assembly comprising:

a sealed disposable bottle including a gas inlet and a beverage outlet;

a sealed pressurized gas cartridge received in the bottle and arranged to be pierced by a separable dispensing assembly when the bottle is loaded into the dispensing assembly;

a first plug blocking a passage in communication with the beverage outlet, the first plug precluding the egress of beverage from the bottle when in a closed position and allowing the egress of beverage from the bottle when in an open position;

a second plug blocking a passage in communication with the gas inlet , the second plug precluding the egress of beverage from the bottle when in a closed position and allowing the ingress of gas into the bottle when in the open position, the ingress being through an inlet passage spaced from outer surfaces of the container assembly and the gas cartridge whereby contaminants therefrom are avoided from being translated into the beverage; and a pressure regulator disposed in the dispensing assembly for regulating gas pressure to the bottle through a regulating valve assembly whereby sanitary pressurized gas is communicated from the cartridge, through the dispensing assembly and back to the bottle.

11. The assembly of claim 10, wherein the first plug comprises a portion of a beverage valve assembly, wherein the first plug is movable between the open position and the closed position.

12. The assembly of claim 10, wherein the first plug is a seal capable of being punctured into the open position.

13. The assembly of claim 10, wherein the second plug comprises a portion of a gas valve assembly and the second plug is movable between the open position and the closed position.

14. The assembly of claim 10, further comprising a cap connected to the bottle for sealing the bottle, the cap including the gas inlet and the beverage outlet.

15. The assembly of claim 14, wherein the cap includes a cylindrical side wall having threads disposed on an internal surface and an end wall disposed at adjacent an end of the side wall and normal to a symmetrical axis of the side wall, the gas inlet and the beverage outlet being formed in the end wall.

16. The assembly of claim 15, wherein the cap includes a cartridge receptacle extending from the end wall and surrounded by the side wall, the pressurized gas cartridge being received in the cartridge receptacle.

17. The assembly of claim 14, further comprising a dip tube extending from the cap into the bottle and in communication with the beverage outlet.

18. A beverage dispensing assembly comprising:

a container having an externally threaded neck and an internal volume;

beer in the internal volume of the container;

a cap threaded onto the container;

a beverage outlet passage in the cap;

a dip tube extending into the internal volume of the container and in fluid communication with the beverage outlet passage;

a pressurized gas inlet passage in the cap;

a regulator including a regulating valve assembly disposed in a separable housing from the container in fluid communication with the pressurized gas inlet and located externally of the internal volume of the container;

a gas cartridge disposed in the cap and in fluid communication with the regulator, wherein pressurized gas exits the gas cartridge at a first pressure and enters the regulator, wherein pressurized gas exits the regulator and enters the pressurized gas inlet passage at a second pressure that is lower than the first pressure, and wherein the pressurized gas at the second pressure enters the internal volume of the container through the pressurized gas inlet passage in the cap to propel the beer through the beverage outlet passage through an inlet passage way spaced from an outer surface of the gas cartridge whereby contaminants therefrom are avoided from being translated into the beverage;

a beverage valve assembly in fluid communication with the dip tube and the beverage outlet passage operable in an open position and in a closed position, the beverage valve assembly prohibiting flow through the beverage outlet passage when in the closed position;

a movable beverage valve actuator in the beverage outlet passage; and, a tap handle operatively connected with the movable beverage valve actuator, wherein rotation of the tap handle results in movement of the beverage valve actuator to place the beverage valve assembly in an open position to dispense the beer through the beverage outlet passage.

19. The assembly of claim 18, further comprising a gas cartridge receptacle connected with the cap.

20. The assembly of claim 19, wherein an internal compartment of the gas cartridge receptacle is not in communication with the internal volume of the container.

21. The assembly of claim 18, further comprising a gas valve assembly disposed between the regulator and the container, wherein the gas valve assembly closes to prevent a beverage in the container from flowing towards the regulator.

22. The assembly of claim 21, wherein the gas valve assembly is a one-way valve.

23. The assembly of claim 18, wherein the beverage valve actuator is hollow.

24. The assembly of claim 18, beverage valve assembly includes a plug and a spring, wherein the spring biases the plug into the closed position.

25. The assembly of claim 24, wherein the beverage valve actuator acts against a biasing force of the spring to place the beverage valve assembly into the open position.

* * * * *